US007474872B2

(12) United States Patent
Nojima

(10) Patent No.: US 7,474,872 B2
(45) Date of Patent: Jan. 6, 2009

(54) SHEET TRANSPORT APPARATUS AND IMAGE FORMING APPARATUS INCLUDING THE SAME

(75) Inventor: Koji Nojima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 483 days.

(21) Appl. No.: 11/225,274

(22) Filed: Sep. 13, 2005

(65) Prior Publication Data

US 2006/0056860 A1 Mar. 16, 2006

(30) Foreign Application Priority Data

Sep. 16, 2004 (JP) ..... 2004-270331

(51) Int. Cl.
*G03G 15/00* (2006.01)
*B65H 5/22* (2006.01)

(52) U.S. Cl. ..... 399/388; 271/3.17; 271/3.16

(58) Field of Classification Search ..... 271/3.14–3.18, 271/4.01, 4.02, 4.03, 4.08, 10.01, 10.02, 271/10.03, 10.04, 10.05; 399/16, 18, 388, 399/405

See application file for complete search history.

(56) References Cited

U.S. PATENT DOCUMENTS 5,225,959 A 7/1993 Stearns
6,827,279 B2 12/2004 Teraura
2004/0246171 A1* 12/2004 Orr et al. ..... 342/174
2006/0056861 A1* 3/2006 Nojima ..... 399/16

FOREIGN PATENT DOCUMENTS

JP 05-005750 A 1/1993
JP 05-034370 A 2/1993
JP 05-215625 A 8/1993
JP 06-331648 A 12/1994
JP 07-115209 A 5/1995
JP 10-087116 A 4/1998
JP 2002-337426 A 11/2002

* cited by examiner

*Primary Examiner*—Daniel J Colilla
*Assistant Examiner*—Allister Primo
(74) *Attorney, Agent, or Firm*—Canon USA Inc IP Div

(57) ABSTRACT

A sheet transport apparatus includes a pair of rollers for transporting a sheet and a sheet detection device for detecting the sheet transported by the pair of rollers. The sheet detection device includes a flag that is displaceable when urged by the sheet transported by the pair of rollers and a single-chip acceleration sensor attached to the flag to detect the arrival of the sheet. When the sheet is brought into contact with the flag to rotate the flag, the acceleration sensor detects the roll acceleration of the flag so as to determine the timing of stopping the pair of rollers on the basis of a detection signal.

24 Claims, 16 Drawing Sheets

SHEET TRANSPORT APPARATUS AND IMAGE FORMING APPARATUS INCLUDING THE SAME

CROSS REFERENCE TO RELATED APPLICATIONS

This application is related to co-pending application Ser. No. 11/225,275 filed on Sep. 13, 2005.

BACKGROUND OF THE INVENTION

1. Field of the Invention

The present invention relates to a sheet transport apparatus for transporting a sheet and detecting the sheet and to an image forming apparatus having the sheet transport apparatus in the apparatus body.

2. Description of the Related Art

For example, known image forming apparatuses for forming an image on a sheet include a sheet transport apparatus that transports a sheet. Examples of the image forming apparatus include a copier, a printer, a facsimile, and a multifunction apparatus combining these functions.

Some sheet transport apparatuses include a sheet detection sensor (refer to, for example, Japanese Patent Laid-Open No. 10-87115). The sheet detection sensor detects, for example, a transported sheet, the shape of sheet curl, and a sheet skew. An electro photographic copier, which is an example of the image forming apparatus, detects the transportation of a sheet fed from a sheet cassette using a sheet detection sensor so as to control the operations of an image forming unit and a heat fusing unit disposed downstream of a transport path on the basis of the detected timing of the sheet detection sensor.

Such sheet detection sensors include, for example, a photo interrupter sensor 858 shown in FIG. 14. The photo interrupter sensor 858 includes a rotatable flag 851 disposed for temporarily interrupting the passage of a sheet S and a photo interrupter 853 to detect the interruption of a detection light beam 853*a*. The flag 851 is brought into contact with a stopper 852*b* by a spring 852*a*, and therefore, the rotation of the flag 851 is restricted.

In the photo interrupter sensor 858, when the transported sheet S hits against the flag 851, the flag 851 rotates about a fulcrum 851*a*. Accordingly, a light interrupting portion 851*b* interrupts the detection light beam 853*a* so that the photo interrupter sensor 858 detects the arrival of the sheet S to output an electric signal. The electric signal is sent to a controller (not shown) that carries out overall control of the copier.

In the image forming apparatus, if a sheet is curled, the image quality and the stacking performance of output sheets may deteriorate. Therefore, information whether a sheet is curled or not is significantly important information. To determine the shape of a curl, a method has been proposed in which the passage position (position in a direction perpendicular to the transport surface of the sheet) of the leading edge of the sheet is detected. In this method, a plurality of photo interrupter sensors having flags of different lengths are provided to detect the passage of the sheet S and the shape of a curl of the sheet S. In FIG. 15, three photo interrupter sensors 858*a*, 858*b*, and 858*c* include flags 851*c*, 851*d*, and 851*e*, respectively.

For example, if the three photo interrupter sensors 858*a*, 858*b*, and 858*c* detect a sheet at the same time, it is determined that the sheet S is curled downwards, as shown in FIG. 15. If the photo interrupter sensor 858*a*, which has the longest flag, detects the sheet S first, it is determined that the sheet S is curled upwards.

Additionally, like the curl of a sheet, the skew of a sheet significantly decreases the image quality. Accordingly, detecting a skew is also an important factor for the image forming apparatus. To detect a skew, as shown in FIG. 16, three photo interrupter sensors 858 are arranged in a direction perpendicular to a sheet feed direction so that the skew of the sheet can be detected from a difference among detection timings of the three photo interrupter sensors 858.

However, as shown in FIG. 17, when only an end portion F at the leading edge of the sheet is curled, the leading edge of the end portion F is located at a position shifted towards the upstream of the sheet feed direction. Accordingly, in the arrangement of the photo interrupter sensors shown in FIG. 16, a curl may be mistakenly detected as a skew. To solve this problem, a plurality of groups including the three photo interrupter sensors 858*a*, 858*b*, and 858*c* having respective flags 851*c*, 851*d*, and 851*e* of different lengths, as shown in FIG. 15, can be provided at positions as shown in FIG. 16.

Although the above-described photo interrupter sensor 858 has a simple structure, the photo interrupter sensor 858 has the following problems:

(1) The photo interrupter sensor 858 that includes the photo interrupter 853 requires a large installation space, and therefore, it is difficult to mount the photo interrupter sensors 858 in some installation areas.

In the photo interrupter sensor 858, the flag 851 needs to be mounted separately from the photo interrupter 853 with a precise spacing therebetween. Therefore, at some installation positions of the photo interrupter sensors 858, there may be no space for the photo interrupter 853. Additionally, when the flag 851 and the photo interrupter 853 are mounted on different parts, it is difficult to ensure the precise spacing therebetween.

(2) A chattering phenomenon tends to occur.

The chattering phenomenon refers to a repetitive motion in which, when the flag 851 pushed down by the sheet S returns to the original position due to a force by the spring 852*a*, the flag 851 hits against the stopper 852*b*, bounces back, and hits against the stopper 852*b* again. When the chattering phenomenon occurs, the photo interrupter sensor 858 unstably interrupts the detection light beam 853*a*, and therefore, the detection timing of the sheet S becomes inaccurate. In known photo interrupter sensors 858, since the flag 851 has the light interrupting portion 851*b*, the total weight of the flag 851 increases, and therefore, the chattering phenomenon easily occurs. Increasing the spring force of the spring 852*a* can prevent this phenomenon. However, the flag 851 does not smoothly rotate when pushed by the sheet S. Consequently, when the sheet S is a thin paper sheet, the leading edge of the sheet S may be damaged.

(3) It is difficult to determine the shape of a curl.

As shown in FIG. 15, the following reason makes it difficult for the three photo interrupter sensors 858*a*, 858*b*, and 858*c* to determine the shape of a curl.

For example, to install a plurality of sets of the three photo interrupter sensors 858*a*, 858*b*, and 858*c*, a large installation space is needed, as described in (1), and therefore, it is difficult to mount the photo interrupter sensors 858 in some areas.

Also, in the photo interrupter sensor 858, a spring force of the spring 852*a* that returns the flag needs to increase in order to prevent the chattering phenomenon described in (2). If the plurality of photo interrupter sensors 858 is arranged, as shown in FIG. 15, the transportation of a thin paper sheet may be blocked.

(4) When the sheet S is skewed, it is difficult to distinguish the skew from a curl of the sheet S.

As shown in FIG. 16, if a plurality of sets of the photo interrupter sensors shown in FIG. 15 are arranged, a thin paper sheet described in (2) may be damaged.

SUMMARY OF THE INVENTION

The present invention is directed to a sheet transport apparatus that includes a single-chip sheet detection sensor and provides easy installation, no chattering phenomenon, and no damage of a transported sheet even when the sheet is thin.

The present invention is also directed to an image forming apparatus that includes a sheet transport apparatus capable of transporting a sheet without a chattering phenomenon and without damage of the transported sheet even when the sheet is thin so as to easily form an image on the sheet.

In one aspect of the present invention, a sheet transport apparatus includes a sheet transport unit configured to transport a sheet and a sheet detection unit configured to detect the sheet transported by the sheet transport unit. The sheet detection unit includes a displacement member displaceable when urged by the sheet transported by the sheet transport unit and a single-chip sheet detection sensor attached to the displacement member and configured to detect the arrival of the sheet.

Further features of the present invention will become apparent from the following description of exemplary embodiments with reference to the attached drawings.

BRIEF DESCRIPTION OF THE DRAWINGS

FIG. 9 illustrates a flag portion of a sheet detection device in the sheet transport apparatus according to the second embodiment of the present invention, where

FIG. 10 illustrates a MEMS pressure sensor, where

FIG. 12 illustrates a flag portion of a sheet detection device in a sheet transport apparatus according to a third embodiment of the present invention, where

FIG. 13 is a perspective view of a sheet detection device in a sheet transport apparatus according to a fourth embodiment of the present invention, where

DESCRIPTION OF THE EMBODIMENTS

A sheet transport apparatus according to an embodiment of the present invention and a copier serving as an image forming apparatus including the sheet transport apparatus are described below with reference to the accompanying drawings.

Examples of the image forming apparatus include a copier, a printer, a facsimile, and a multi-function apparatus including these units. Therefore, the image forming apparatus according to the present invention is not limited to a copier.

Additionally, the sheet transport apparatus can be integrated into not only an image forming apparatus but also an apparatus that handles a sheet, such as a sheet punch unit for punching a sheet and a sheet folder unit for folding a sheet. That is, the sheet transport apparatus is not limited to be integrated into a copier.

Copier

Figure 1:
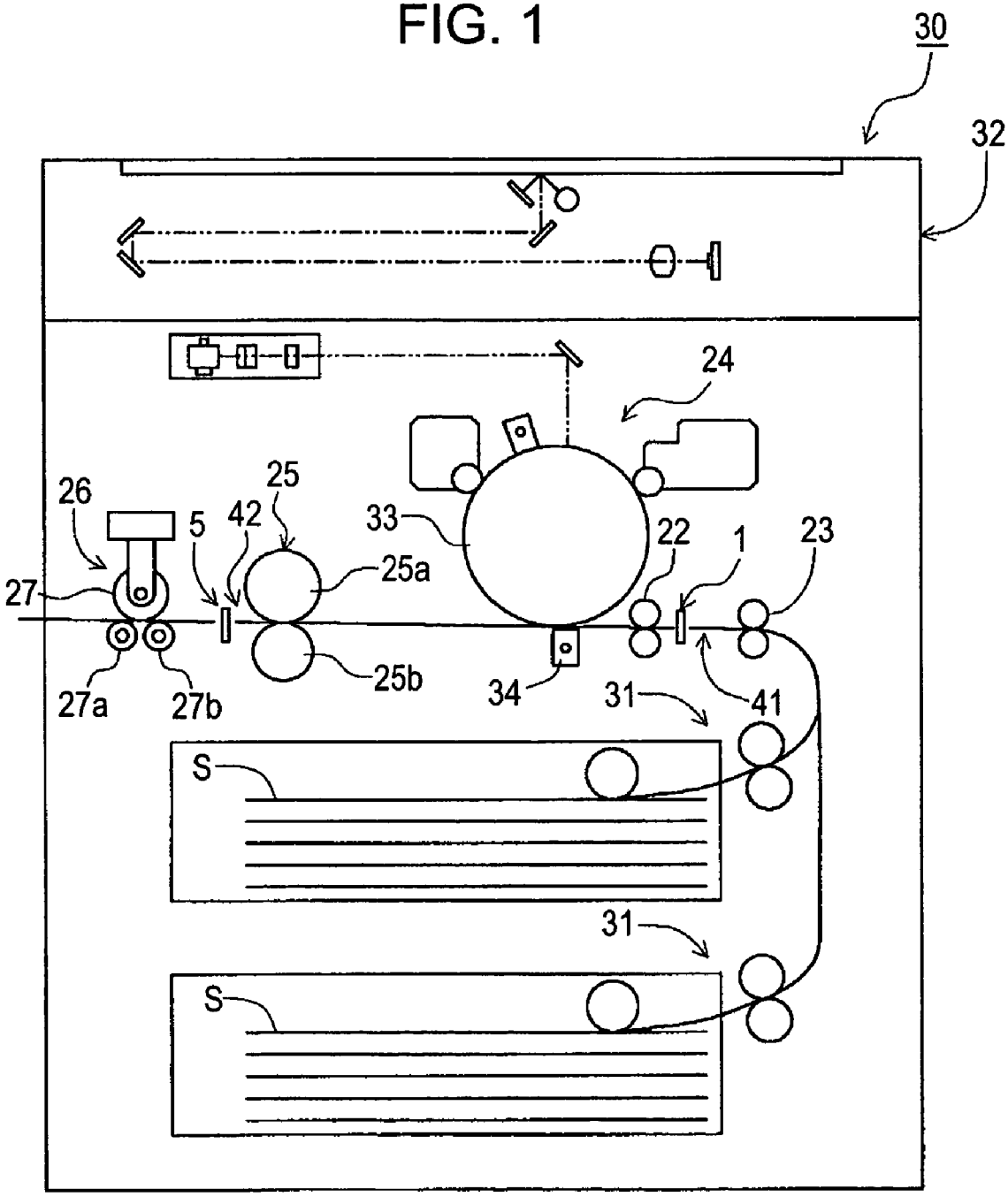
FIG. 1 is a front sectional view of a copier serving as an image forming apparatus according to an embodiment of the present invention.

FIG. 1 is a front sectional view of a copier serving as an image forming apparatus. A copier 30 includes a reader unit 32, a sheet feeder unit 31, a sheet transport apparatus 41, an image forming unit 24, and a heat fusing unit 25.

A sheet is fed from the sheet feeder unit 31, passes through a pair of rollers 23 and the sheet transport apparatus 41, which constitute a sheet transport unit, and is urged against a pair of resist rollers 22 to correct a skew. After the skew is corrected, the sheet is delivered to the image forming unit 24 including a photoconductor drum 33 at a predetermined timing. On the photoconductor drum 33, a toner image of an original document image read by the reader unit 32 is formed. The toner image is transferred to the sheet by a transfer charger 34. Thereafter, the sheet is delivered to the heat fusing unit 25, which fuses the toner image on the sheet by applying heat and pressure. Finally, the sheet curled in the toner-image fusing process due to the applied heat and pressure is decurled by a decurler unit 26 and is ejected outside an apparatus body of the copier 30.

Sheet Transport Apparatus According to First Embodiment

A sheet transport apparatus according to a first embodiment of the present invention is described below with reference to FIGS. 2 through 7.

The sheet transport apparatus 41 includes the pair of rollers 23 driven by a driving unit (not shown) and a sheet detection device 1.

Figure 2:
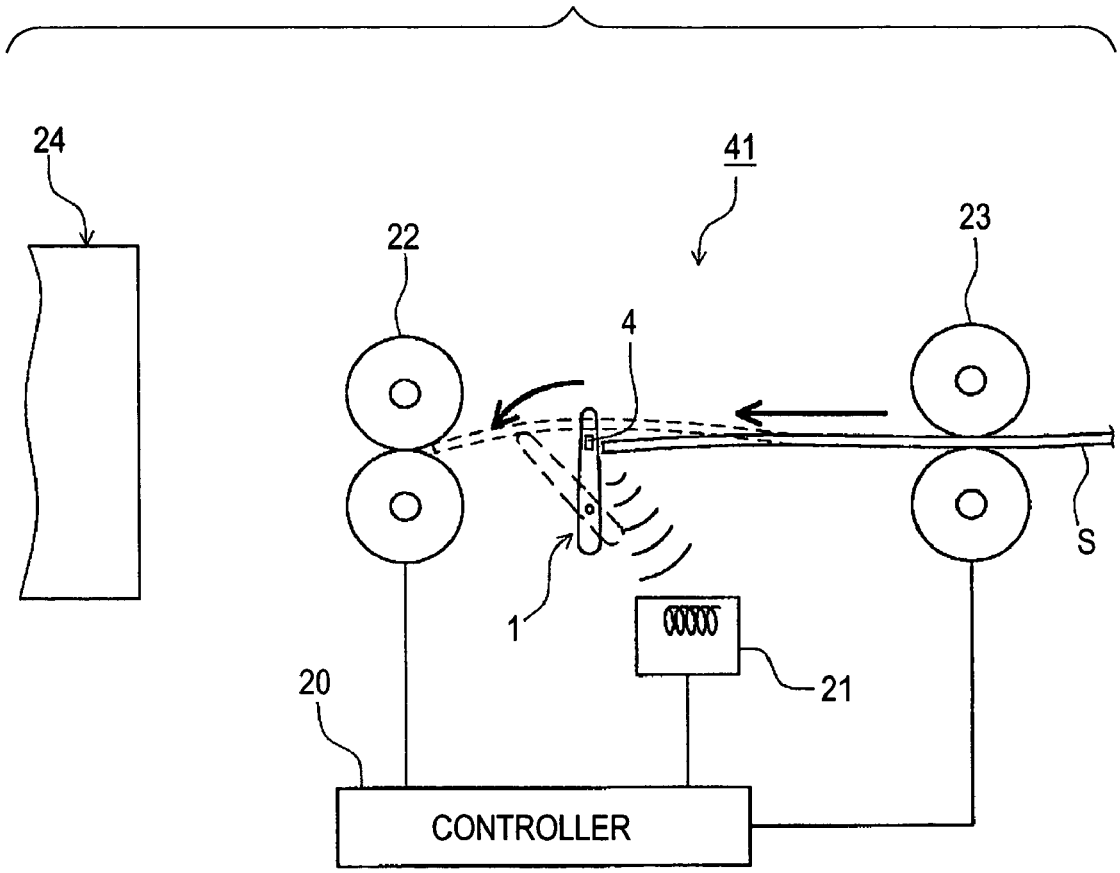
FIG. 2 is a front view of a sheet transport apparatus according to a first embodiment of the present invention.
Figure 3:
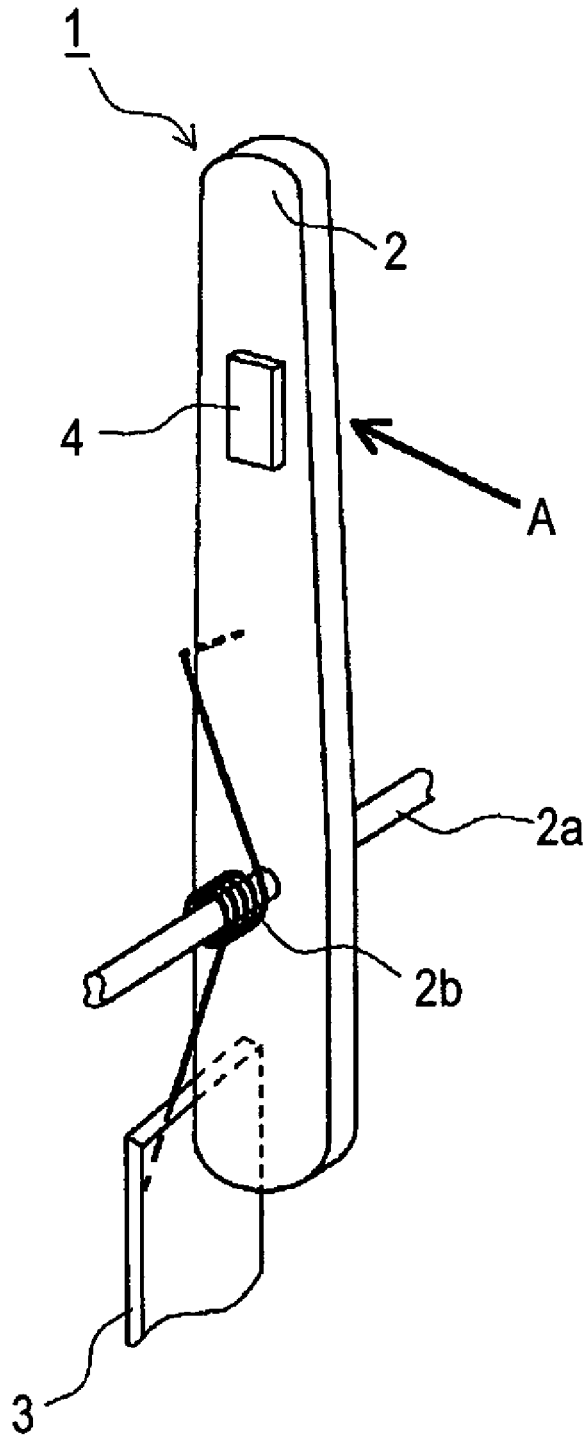
FIG. 3 is a perspective view of a flag portion shown in FIG. 2.

As shown in FIG. 3, the sheet detection device 1 includes a flag 2, which is a displacement member rotatably supported by a spindle 2*a*, a stopper 3 for stopping the flag 2, a spring 2*b* for biasing the flag 2 towards the stopper 3, a single-chip acceleration sensor 4 serving as a sheet detection sensor, a transmission and reception unit 21 (see FIG. 2) for communicating information with the acceleration sensor 4, and a controller 20 for controlling the rotation of the pair of rollers 23 and the pair of resist rollers 22 on the basis of a signal from the transmission and reception unit 21. The acceleration sensor 4 may be connected to the controller 20 via a signal line without using the transmission and reception unit 21. The flag 2 is disposed so that the length direction thereof is perpendicular to the transport surface of the sheet, that is, the length direction thereof intersects the transport surface of the sheet. The flag 2 is tilted by the transported sheet urging against the flag 2.

The sheet detection device 1 determines a timing of stopping the rotation of the pair of rollers 23 by the following operation:

First, the pair of rollers 23 transports an incoming sheet. The flag 2 rotates when the sheet is brought into contact with, for example, a point shown by arrow A in FIG. 3. At that time, the acceleration sensor 4 rotates along with the flag 2 to detect the roll acceleration. The angular velocity information of the rotation is transmitted to the transmission and reception unit 21. The controller 20 determines the incoming timing of the sheet on the basis of an angular velocity information signal received by the transmission and reception unit 21, and sets the timing of stopping the rotation of the pair of rollers 23.

The flag 2 can smoothly rotate only if the acceleration sensor 4 is lightweight. Unless the flag 2 smoothly rotates, the acceleration sensor 4 detects the arrival of the sheet after a slight delay. Also, the flag 2 may damage the leading edge of the sheet. Accordingly, the acceleration sensor 4 is a compact and lightweight sensor that easily rotates along with the flag 2.

In this embodiment, the acceleration sensor 4 can be a microelectromechanical system (hereinafter simply referred to as "MEMS") sensor that is an ultra small and lightweight chip sensor a few millimeters on a side. A MEMS acceleration sensor is manufactured using a MEMS technology.

MEMS Acceleration Sensor (1) MEMS Technology

The MEMS technology is a technology in which an ultra small mechanical structure and an electric circuit are formed on a substrate using an exposure process used for semiconductor manufacturing. Using the MEMS technology significantly reduces the manufacturing cost of an ultra small sensor which would otherwise be very difficult to manufacture. Such MEMS acceleration sensors have already been widely used in practical applications. For example, Japanese Patent Laid-Open No. 05-5750, Japanese Patent Laid-Open No. 5-34370, and Japanese Patent Laid-Open No. 6-331648 disclose the structure of an acceleration sensor manufactured using the MEMS technology. The MEMS acceleration sensor disclosed in Japanese Patent Laid-Open No. 6-331648 is described below.

(2) Structure of MEMS Acceleration Sensor

Figure 4:
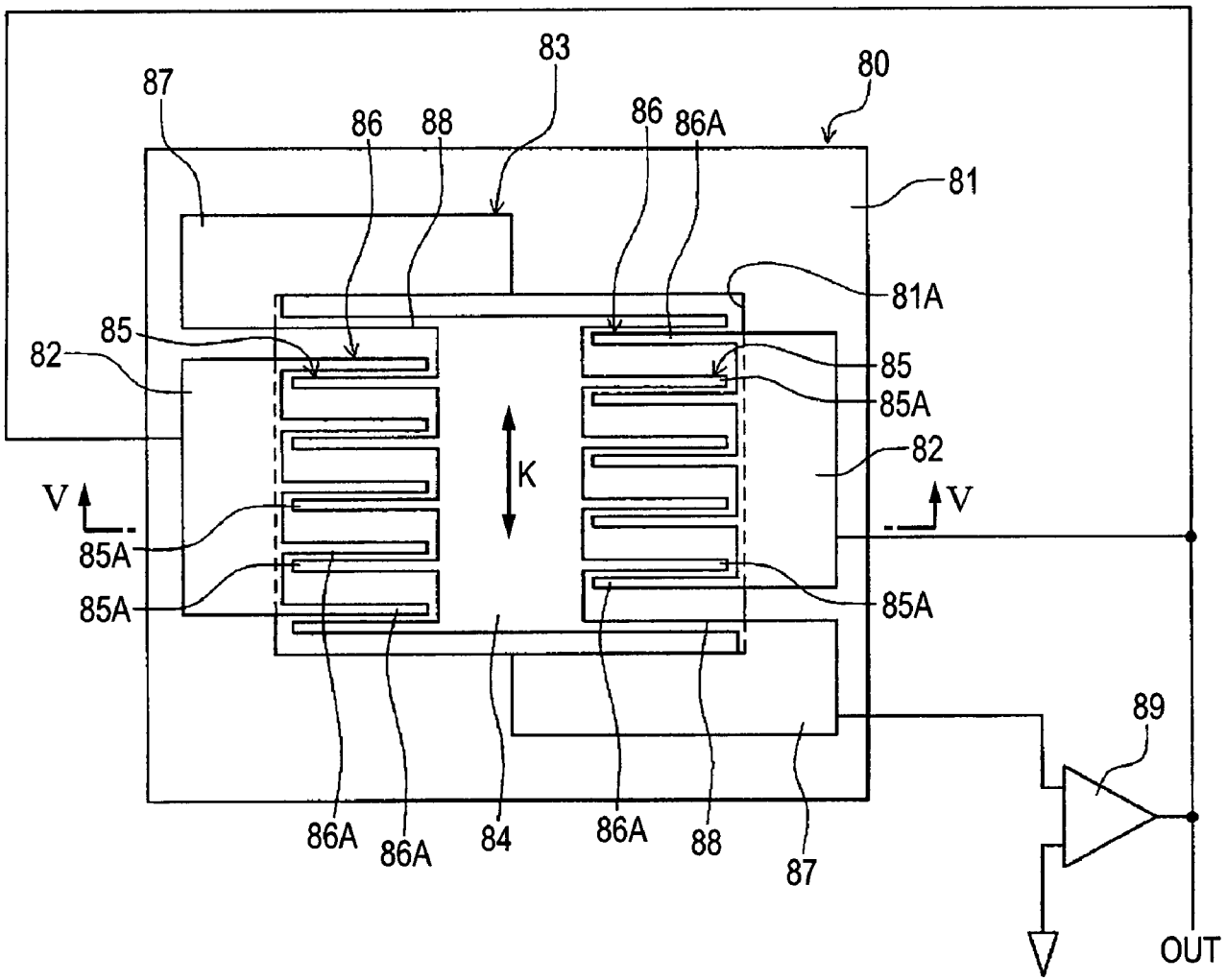
FIG. 4 is a schematic diagram illustrating the structure of a MEMS acceleration sensor.
Figure 5:
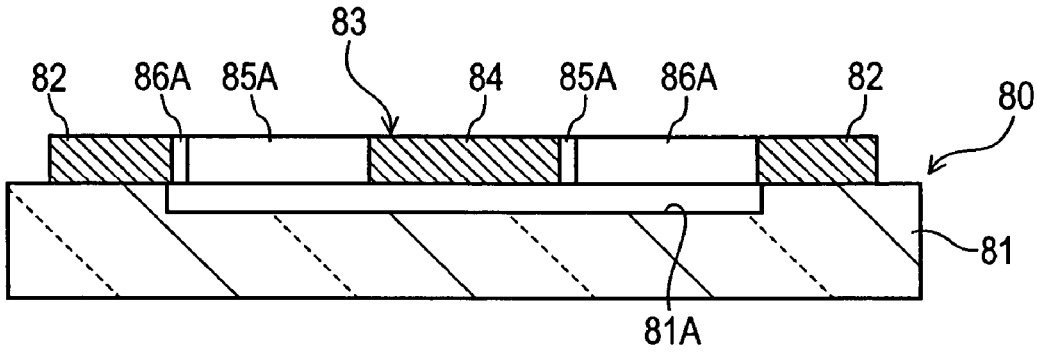
FIG. 5 is a sectional view of the MEMS acceleration sensor taken along a line V-V of FIG. 4.

As shown in FIG. 4, a fixed portion 82 serving as an electrode made from a silicon material and a movable portion 83 serving as a detection unit are formed on an insulating glass substrate 81 of a MEMS acceleration sensor 80. Furthermore, a rectangular recess portion 81A is formed on the glass substrate 81. In the recess portion 81A, a mass portion 84 including a movable comb-shaped electrode 85 is disposed in a displaceable manner in a direction shown by arrow K in FIG. 4, that is, in a direction in which the acceleration is applied.

Two fixed portions 82 are separately provided at the left and right sides on the glass substrate 81. A plurality of thin electrode plates 86A (for example, five electrodes) are formed on each of the portions of the two fixed portions 82 facing each other. The plurality of electrode plates 86A function as a comb-shaped electrode 86, which is a fixed electrode on the fixed portion.

The movable portion 83 includes two supporting portions 87 secured at the front and back of the glass substrate 81, the mass portion 84 supported by a thin plate beam 88, and a plurality of thin electrode plates 85A (for example, five electrodes) extending from the mass portion 84 to the left and right. The plurality of electrode plates 85A functions as a comb-shaped electrode 85, which is a movable electrode on the movable portion.

A small gap is formed between the electrode plates 85A of the movable comb-shaped electrode 85 and the electrode plates 86A of the fixed comb-shaped electrode 86. The spacing of the gap changes as the mass portion 84 moves in the K direction due to the acceleration of the acceleration sensor 80 in the K direction. The fixed portion 82 and the movable portion 83 are connected to an amplifier 89.

(3) Manufacturing Process of MEMS Acceleration Sensor

The MEMS acceleration sensor 80 is manufactured by the following steps. The steps are described next with reference to FIGS. 4 through 6.

A plurality of the mass portions 84, the electrode plates 85A, the electrode plates 86A, and the fixed portions 82 are formed on a silicon wafer having a diameter of about 7.5 to 15.5 cm and a thickness of about 300 μm by a masking and etching process.

A plurality of the recess portions 81A are formed on a circular glass substrate having the same size as the silicon wafer by a glass etching process.

Figure 6:
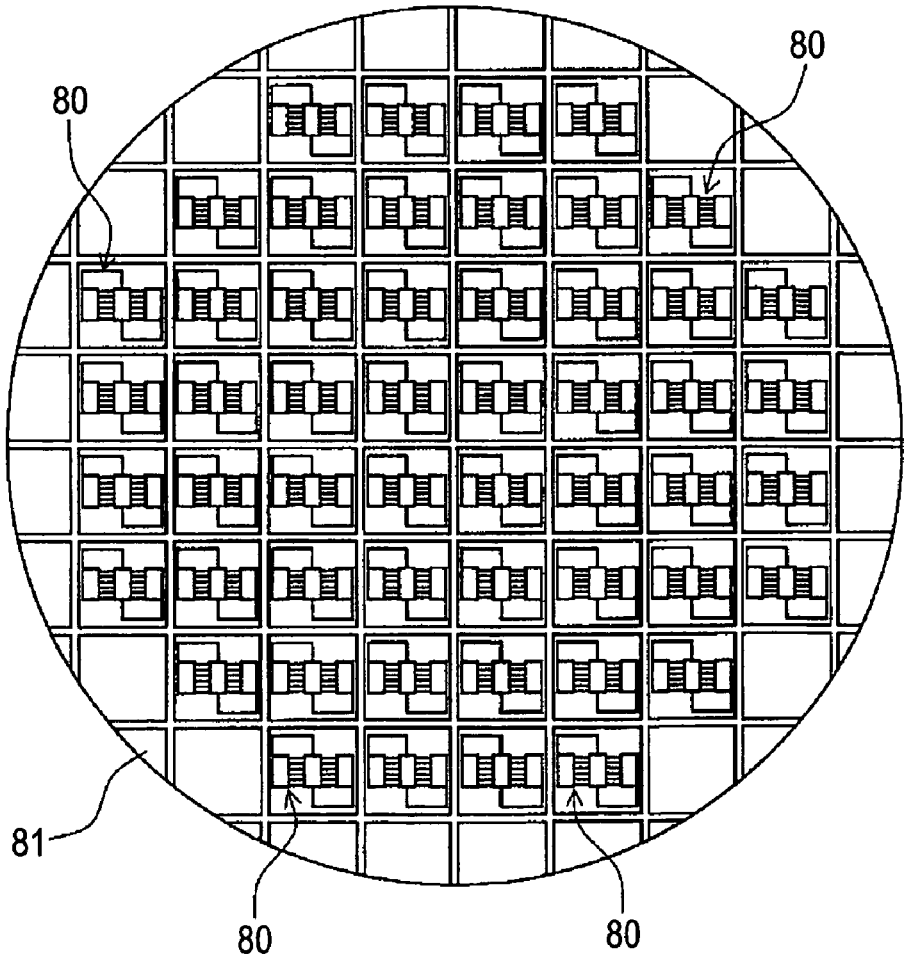
FIG. 6 is a plan view of a glass substrate on which a plurality of MEMS acceleration sensors is formed.

As shown in FIG. 6, the glass substrate is bonded to the silicon wafer by an anodic bonding process so that a plurality of the MEMS acceleration sensors 80 are formed on the glass substrate 81.

The plurality of the MEMS acceleration sensors 80 formed on the glass substrate 81 are cut into chips a few millimeters on a side.

The above-described steps manufacture several tens of compact and lightweight MEMS acceleration sensors 80 at one time. The amplifier 89 shown in FIG. 4 can be formed on the glass substrate 81 at the same time using a known semiconductor manufacturing technology. In addition to the structure of the MEMS acceleration sensor 80, the structure manufactured by the MEMS technology, in general, has a significant advantage in that peripheral circuits can be formed on a substrate at the same time as the structure.

(4) Operation of MEMS Acceleration Sensor

Upon being accelerated in the K direction shown in FIG. 4, the MEMS acceleration sensor 80 changes a spacing of a small gap between the electrode plates 85A and the electrode plates 86A. The change in the spacing is converted to the change in electrostatic capacitance, which is amplified by the amplifier 89 and is output. The MEMS acceleration sensor 80 can externally transfer the magnitude of the acceleration by changing the magnitude of the output. In the MEMS acceleration sensor 80 according to this embodiment, since each of the electrode plates 85A is electrically connected to each of the electrode plates 86A in parallel, the acceleration can be detected from the total electrostatic capacitance between the electrode plates 85A and 86A. As a result, the sensitivity and accuracy of the detection can be increased.

(5) Other Features of MEMS Acceleration Sensor (Wireless Configuration)

Figure 7:
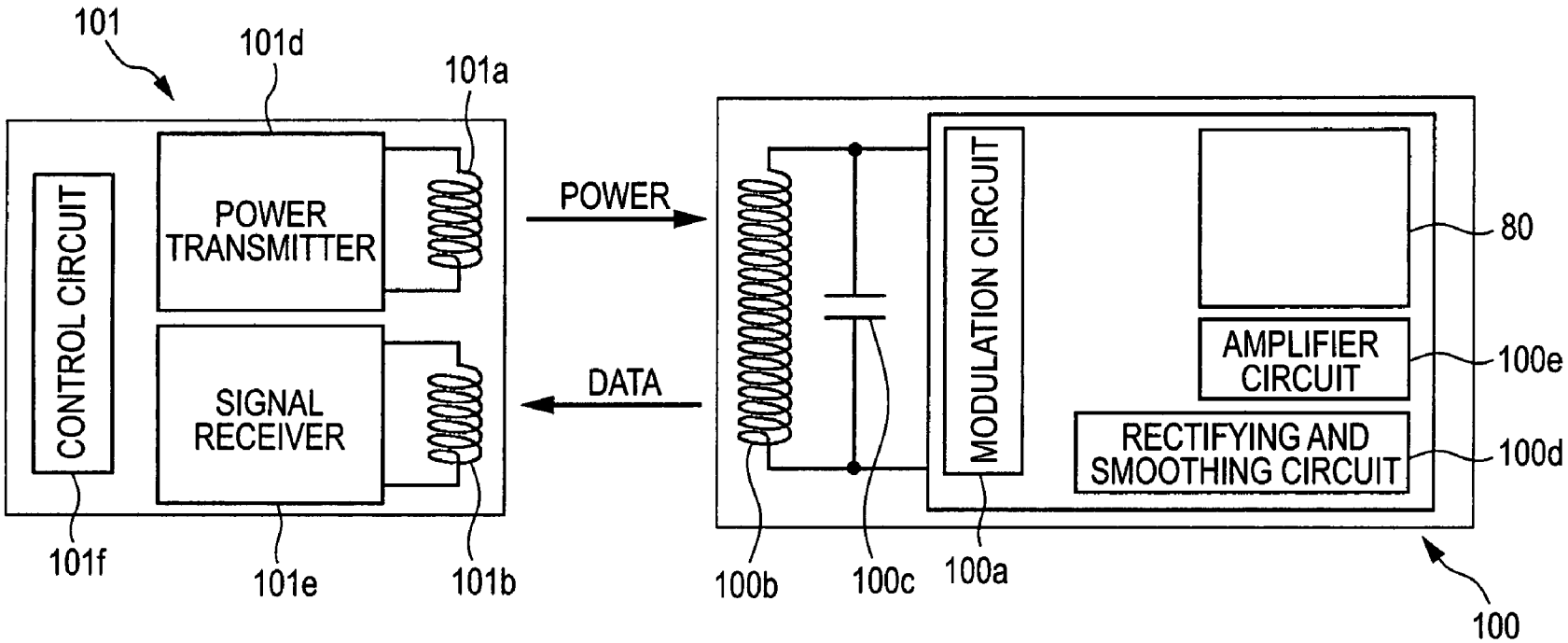
FIG. 7 is a circuit diagram in which a wireless circuit is connected to the MEMS acceleration sensor.

As described in (3), in sensors using the MEMS technology, peripheral circuits can be easily formed on a substrate. Accordingly, as shown in FIG. 7, the sensor can have a wireless configuration by including a transmission and reception circuit. Such a wireless technology has been widely used in practical applications including a radio frequency identification (RFID) tag (refer to, for example, Japanese Patent Laid-Open No. 2002-337426).

FIG. 7 illustrates an acceleration sensor unit 100 in which the MEMS acceleration sensor 80 and a wireless circuit are formed on a single substrate. In the acceleration sensor unit 100, the MEMS acceleration sensor 80 includes an amplifier circuit 100*e*, a rectifying and smoothing circuit 100*d*, a modulation circuit 100*a*, and an antenna coil 100*b*. The acceleration sensor unit 100 can wirelessly receive electrical power from and can transmit a signal to an electrical-power transmission and signal reception unit 101. An electrical power radio signal emitted from a power transmitter 101*d* and a power supplying coil 101*a* is received by the antenna coil 100*b*, which forms a resonance circuit in cooperation with a resonance capacitor 100*c*. The electrical power radio signal is converted into operating electrical power by the rectifying and smoothing circuit 100*d*. The electrical power is then supplied to the whole acceleration sensor unit 100. In contrast, a signal output from the MEMS acceleration sensor 80 is amplified by the amplifier circuit 100*e* and is then modulated by the modulation circuit 100*a*. The signal is then transmitted from the antenna coil 100*b* to a data reception coil 101*b*. The signal received by the data reception coil 101*b* is transferred to a control circuit 101*f* via a signal receiver 101*e*.

Thus, since the acceleration sensor unit 100 employs wireless communication, a communication cable for externally communicating is eliminated, and therefore, the acceleration sensor unit 100 can be freely placed at any location. In this embodiment, the acceleration sensor 4 is mounted on the flag 2. If a driving mechanism is arranged in the vicinity of the flag 2, wiring becomes difficult. In such a case, the acceleration sensor 4 that is wireless is significantly effective.

FIG. 2 illustrates the operation of the sheet transport apparatus 41 including the acceleration sensor 4 produced by using the above-described MEMS technology.

As shown in FIG. 2, the transmission and reception unit 21 has the same structure as the electrical power transmission and signal reception unit 101. The pair of resist rollers 22 is disposed upstream of the image forming unit 24. When the pair of resist rollers 22 stops its rotation, the leading edge of the sheet S hits against the pair of resist rollers 22, thus correcting the skew of the sheet S and also adjusting the timing of delivering the sheet S to the image forming unit 24. To appropriately correct the skew of the sheet S using the pair of resist rollers 22, it is important that the timing when the sheet S reaches the acceleration sensor 4 is accurately detected and the pair of rollers 23 is stopped at an appropriate timing. The copier 30 employs an electro photographic technology in which the image forming unit 24 forms a toner image on a photoconductor drum and transfers the toner image onto a sheet, and the heat fusing unit 25 fuses the toner image on the sheet by applying heat and pressure to the sheet. However, according to the present invention, the copier 30 may employ an inkjet technology in which ink drops are ejected onto a sheet to form an image.

In the sheet transport apparatus 41 having such a structure, when the sheet S is transported so as to be brought into contact with the flag 2, the flag 2 is urged by the sheet S, and therefore, the flag 2 rotates. The acceleration sensor 4 also rotates along with the flag 2. At that time, the acceleration sensor 4 detects the acceleration of the rotation of the flag 2. The acceleration sensor 4 then transmits a detection signal to the transmission and reception unit 21 via wireless communication. The controller 20 receives the detection signal from the transmission and reception unit 21 to determine the timing of arrival of the sheet S at the pair of rollers 23. The controller 20 then determines the timing of stopping the rotation of the pair of rollers 23 on the basis of the determination of arrival of the sheet S and stops the rotation of the pair of rollers 23. After the image forming unit 24 becomes ready for forming an image, the controller 20 starts the rotation of the pair of resist rollers 22 to feed the sheet S.

Alternatively, the controller 20 may stop the rotation of the pair of resist rollers 22. Thus, the rotation of the pair of rollers 23 causes the leading edge of the sheet S to be brought into contact with the pair of resist rollers 22, and the sheet S is laterally convexly curved, as shown by a dashed line in FIG. 2. Accordingly, the skew of the sheet S is corrected. After the image forming unit 24 becomes ready for forming an image, the controller 20 may start the rotation of the pair of resist rollers 22 to feed the sheet S.

By adopting the sheet detection device 1 having the acceleration sensor 4, the sheet transport apparatus 41 can provide the following specific advantages compared with known sheet transport apparatuses:

(1) Since the sheet transport apparatus 41 eliminates the photo interrupter 853 that the known detection sensors include, a large installation space is not required compared with the known sheet transport apparatus. This facilitates the installation of the sheet transport apparatus 41. In addition, the accuracy of the install position can be increased.

That is, although only the sheet transport apparatus 41 is shown in FIG. 2, a plurality of sheet transport paths, in practice, are joined together and a plurality of transport rollers and guide plates are densely arranged in front of the image forming unit 24 (upstream of sheet feed direction). Even in this situation, the simple acceleration sensor 4 that does not require a large installation space is not significantly restricted with respect to the installation space, and therefore, the acceleration sensor 4 can be installed at an appropriate position. Additionally, if the sheet detection device 1 has a wireless configuration, the installation is not restricted by wiring constraints of communication lines. Therefore, the installation is further facilitated. Moreover, since signal lines do not prevent the motion of the flag 2, the sheet S can pass through the flag 2 smoothly.

(2) The sheet transport apparatus 41 eliminates the light interrupting portion 851*b*, which is included in the known sheet transport apparatus, to reduce a chattering phenomenon. In addition, the value of acceleration detected by the acceleration sensor 4 becomes maximum when the leading edge of the sheet S collides with the flag 2. Consequently, by using the value of acceleration to detect the collision of the leading edge of the sheet S, the risk of an erroneous detection can be decreased even when the chattering phenomenon occurs. Moreover, the lighter flag 2 decreases the risk of damaging the leading edge of the sheet S even though the sheet S is thin.

In this embodiment, an acceleration sensor is used. However, a pressure sensor described below may be used. In this case, the above-described advantages (1) and (2) can be also obtained.

Figure 12A:
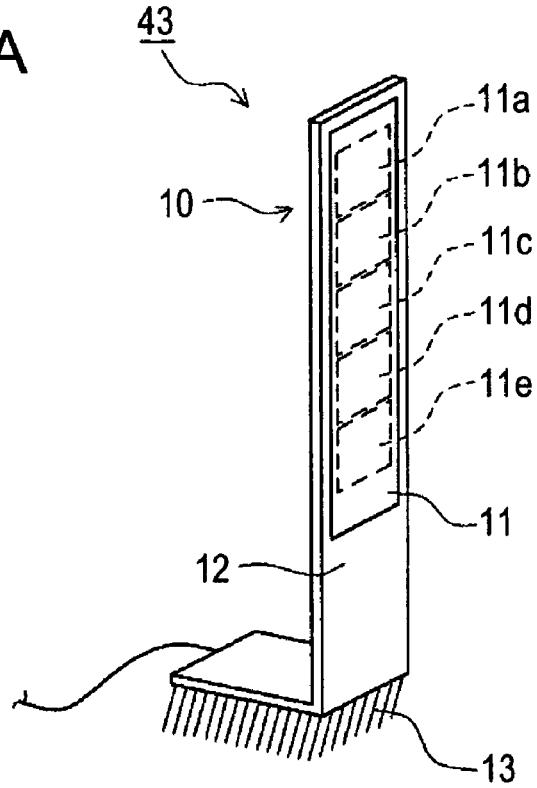
FIG. 12A is a perspective view of the flag portion and FIG. 12B is a perspective view of the flag portion when pushed by a sheet and deflected in the transport direction of the sheet.

Additionally, although the flag 2 is tilted about the spindle 2*a* in this embodiment, a plate flag made from an elastic material may be used, as shown in FIG. 12A.

Sheet Transport Apparatus According To Second Embodiment

A sheet transport apparatus according to a second embodiment of the present invention is described below with reference to FIGS. 8 through 11.

A sheet transport apparatus 42 is configured in combination with a heat fusing unit 25. The sheet transport apparatus 42 includes a pressure roller 25*b* and a heat roller 25*c*, which are driven by a driving unit (not shown), and a sheet detection device 5. The pressure roller 25*b* and the heat roller 25*c* are used by both the heat fusing unit 25 and the sheet transport apparatus 42. The heat fusing unit 25 is described in detail later.

Figure 8:
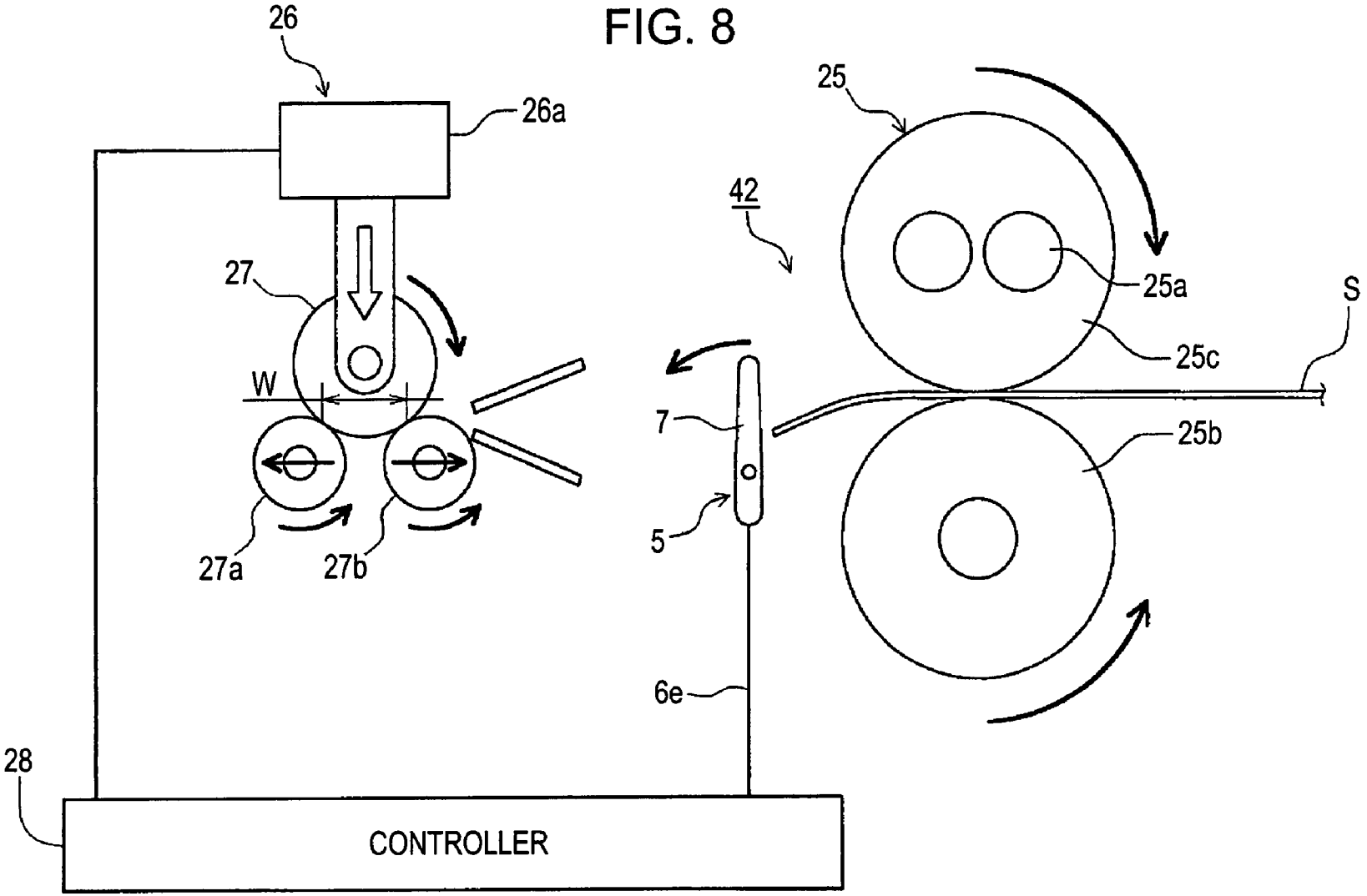
FIG. 8 is a front view of a sheet transport apparatus according to a second embodiment of the present invention.
Figure 9A:
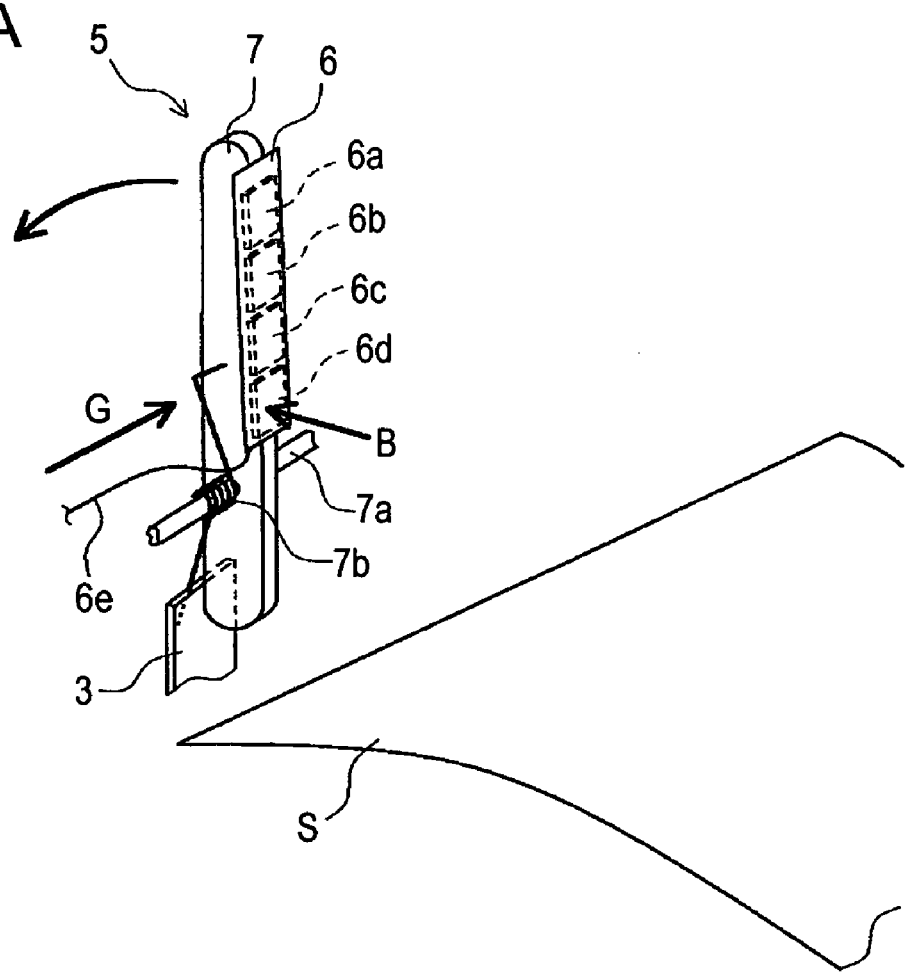
FIG. 9A is a perspective view of the flag portion and FIG. 9B is a diagram of the flag portion viewed from arrow G shown in FIG. 9A.
Figure 9B:
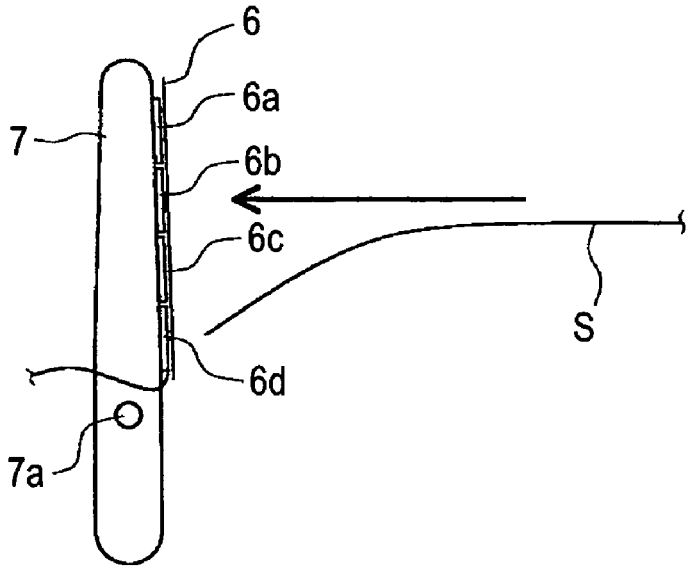

As shown in FIGS. 8 and 9A, the sheet detection device 5 includes a flag 7, which is a displacement member rotatably supported by a spindle 7*a*, a stopper 3 for stopping the flag 7, a spring 7*b* for biasing the flag 7 towards the stopper 3, single-chip pressure sensors 6*a* to 6*d* serving as sheet detection sensors secured to the flag 7, a sheet cover for protecting the surfaces of the pressure sensors 6*a* to 6*d*, and a controller 28 connected to the pressure sensors 6*a* to 6*d* via a signal line 6*e*. Upon receiving a sheet detection signal from the pressure sensors 6*a* to 6*d*, the controller 28 controls a decurler unit 26. As in the sheet transport apparatus 41 of the first embodiment, a transmission and reception unit may transmit and receive the sheet detection signal between the pressure sensors 6*a* to 6*d* and the controller 28 without using the signal line 6*e*. The flag 7 is disposed so that the length direction thereof is perpendicular to the transport surface of the sheet S, that is, the length direction thereof intersects the transport surface of the sheet S. The flag 7 is tilted by the transported sheet urging against the flag 7.

The sheet detection device 5 transports the incoming sheet S by the pressure roller 25*b* and the heat roller 25*c*. When the sheet S is brought into contact with either one of the pressure sensors 6*a* to 6*d* (for example, 6*d* shown by the arrow B in FIG. 9A), the sheet detection device 5 can detect the leading edge of the sheet S. When the leading edge of the sheet S is brought into contact with the pressure sensor 6*d*, the flag 7 is urged by the sheet S and is tilted towards the downstream of sheet feed direction to allow the sheet S to pass through. A detection signal from the pressure sensor 6*d* is transmitted to the controller 28 via the signal line 6*e*.

The flag 7 can smoothly rotate only if the pressure sensors 6*a* to 6*d* are lightweight. Unless the flag 7 smoothly rotates, the flag 7 may damage the leading edge of the sheet S. Also, the sheet S may be jammed. Accordingly, the pressure sensors 6*a* to 6*d* are compact and lightweight sensors that easily rotate along with the flag 7.

The pressure sensors 6*a* to 6*d* used in this embodiment are ultra small and lightweight chip sensors a few millimeters on a side. The pressure sensors 6*a* to 6*d* are densely arranged. In such a situation, MEMS pressure sensors can be suitably used as the pressure sensors 6*a* to 6*d*. The MEMS pressure sensors are manufactured using the MEMS technology.

MEMS Pressure Sensor (1) MEMS Technology

A MEMS pressure sensor is a pressure sensor that is manufactured by using the MEMS technology. In the MEMS pressure sensor, a plurality of ultra small pressure sensing elements can be densely arranged in a limited area. Such MEMS pressure sensors have already been widely used in practical applications. For example, Japanese Patent Laid-Open No. 7-115209 and Japanese Patent Laid-Open No. 5-215625 disclose the structure of a pressure sensor manufactured using the MEMS technology. The MEMS pressure sensor disclosed in Japanese Patent Laid-Open No. 5-215625 is described below.

(2) Structure of MEMS Pressure Sensor

Figure 10A:
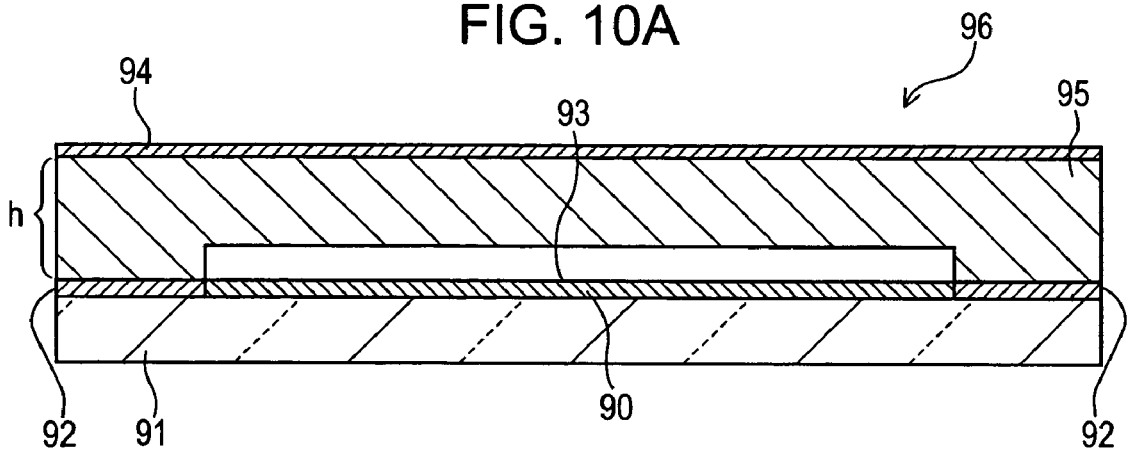
FIG. 10A is a sectional view of the MEMS pressure sensor and FIG. 10B is a circuit diagram of a sensor unit including a plurality of the MEMS pressure sensors.

As shown in FIG. 10A, a MEMS pressure sensor 96 includes a glass substrate 91 and a rectangular plate 90 formed on the glass substrate 91. The plate 90 is composed of a conductive thin film and is coated with a thin dielectric material 93 for protecting the plate 90 from corrosion, an elastically deformable elastomer 95, and a conductive film 94. The plate 90 forms a capacitor in cooperation with the conductive film 94. An electronic circuit 92 (see FIG. 10A) is formed on the glass substrate 91 to amplify the output of the capacitor and externally output it. The MEMS pressure sensor 96 having such a structure can detect pressure applied to the conductive film 94, which changes the capacitance of the capacitor in response to the pressure.

(3) Manufacturing Process of MEMS Pressure Sensor

As shown in FIG. 6, a plurality of MEMS pressure sensors 96 is densely formed on a glass substrate by using a semiconductor manufacturing process, such as an etching process. Additionally, when forming peripheral circuits on the glass substrate, the peripheral circuits may be connected together so as to produce a pressure sensor unit including a plurality of the MEMS pressure sensors 96.

Figure 10B:
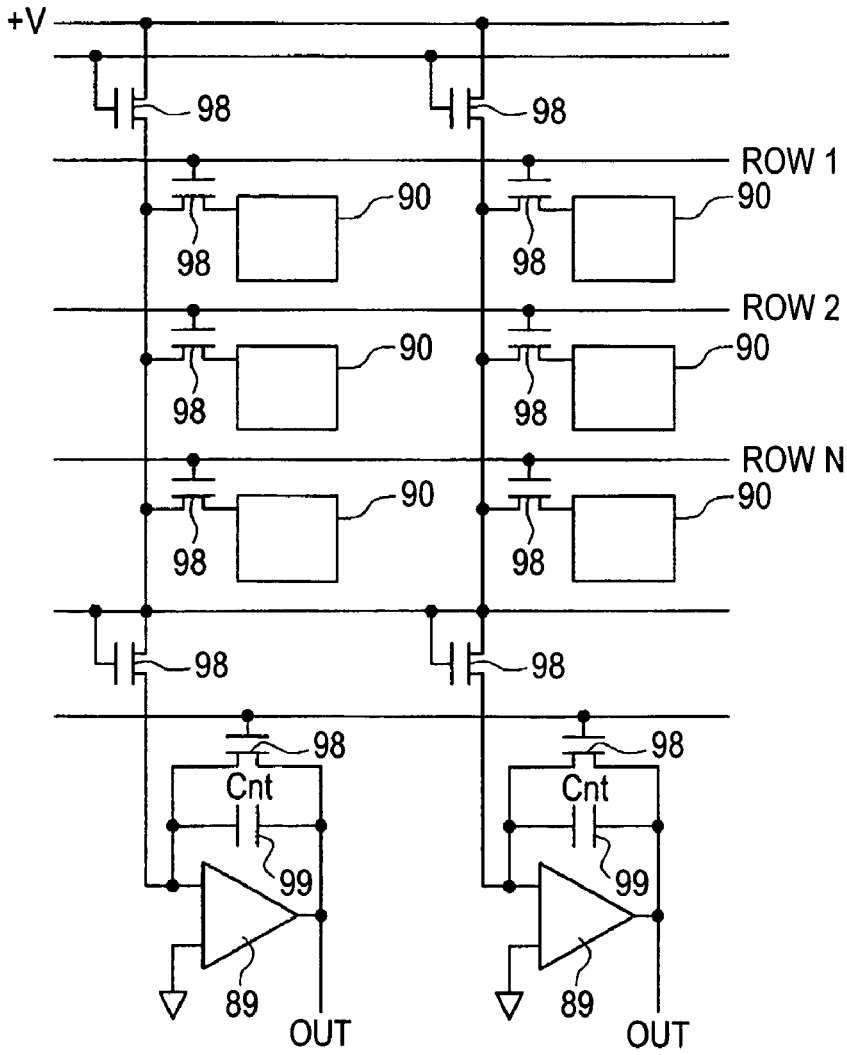

(4) Structure of Pressure Sensor Unit Including a Plurality of Densely Arranged MEMS Pressure Sensors FIG. 10B is a circuit diagram of a sensor unit including a plurality of the MEMS pressure sensors 96. A thin-film transistor (TFT) 98, an integrating capacitor 99, and an amplifier 89 are formed on a single glass substrate along with the plate 90 of the MEMS pressure sensor 96. This circuit is coated with the above-described thin dielectric material 93, elastomer 95, and conductive film 94 to form the sensor unit. In this embodiment, the output from each MEMS pressure sensor 96 can be sequentially transferred externally by controlling a switch of the TFT 98. Such a circuit configuration is disclosed in, for example, Japanese Patent Laid-Open No. 5-215625 as a circuit in a computer tablet. Thus, using the MEMS technology facilitates the manufacturing of a pressure sensor unit including a plurality of densely arranged pressure sensors. Accordingly, the in-line pressure sensors 6*a* to 6*d* shown in FIG. 9A can serve as a pressure sensor unit by using the MEMS technology.

As shown in FIG. 8, the sheet detection device 5 including a pressure sensor produced using the MEMS technology can be used at the downstream side of the heat fusing unit 25 of the copier 30 (see FIG. 1). The heat fusing unit 25 includes the heat roller 25*c* incorporating a halogen heater 25*a* and the pressure roller 25*b*. The heat fusing unit 25 fuses a toner transferred on the sheet S by the image forming unit 24 (see FIG. 1) onto the sheet S.

The heat fusing unit 25 tends to curl the sheet S due to heat applied to the sheet S. Therefore, in the copier 30, defective stacking possibly occurs when the sheet S is output to outside the copier 30 and is stacked. To solve this problem, in many copiers that require a high print quality of the sheet S, the decurler unit 26 is disposed at the downstream side of the heat fusing unit 25. The decurler unit 26 urges a decurler roller 27 onto driven rollers 27*a* and 27*b* and passes the sheet S therethrough to cause the sheet S to follow the curve of the surface of the decurler roller 27. Accordingly, the sheet S is decurled into a flat sheet. Additionally, by changing a suppression strength of the decurler roller 27, the decurler unit 26 can adjust a distance W between two nips so as to appropriately decurl the sheet S in accordance with the curled condition of the sheet S. For example, when the sheet S is strongly curled, the decurler unit 26 increases the distance W between the two nips to increase the decurling strength.

When the sheet S is delivered to the heat fusing unit 25 and the leading edge of the sheet S reaches the heat fusing unit 25, the sheet detection device 5 can determine the curled condition of the sheet S from the contact point of the sheet S with respect to the sheet detection device 5. For example, if the sheet S is brought into contact with the lower pressure sensor 6*d* among the pressure sensors 6*a* to 6*d* of the sheet detection device 5 and the detection signal from the pressure sensor 6*d* is transmitted to the controller 28, the controller 28 determines that a large down curl occurs and controls a decurler motor 26*a* to increase the suppression strength of the decurler roller 27 so that the decurler unit 26 decurls the sheet S.

By adopting the sheet detection device 5 including the pressure sensors 6*a* to 6*d*, the sheet transport apparatus 42 according to the second embodiment can provide the following specific advantages compared with known sheet transport apparatus:

(1) As in the sheet transport apparatus 41 of the first embodiment, since the sheet transport apparatus 42 eliminates the photo interrupter 853 that the known detection sensors include, a large installation space is not required compared with the known sheet transport apparatus. This facilitates the installation of the sheet transport apparatus 42. In addition, the accuracy of the install position can be increased. Moreover, if the sheet detection device 5 has a wireless configuration, the installation is not restricted by wiring constraints of communication lines. Therefore, the installation is further facilitated. Furthermore, since signal lines do not prevent the motion of the flag 7, the sheet S can pass through the flag 7 smoothly.

(2) As in the sheet transport apparatus 41 of the first embodiment, the sheet transport apparatus 42 has a structure that can be easily installed and that can reduce a chattering phenomenon.

Figure 14:
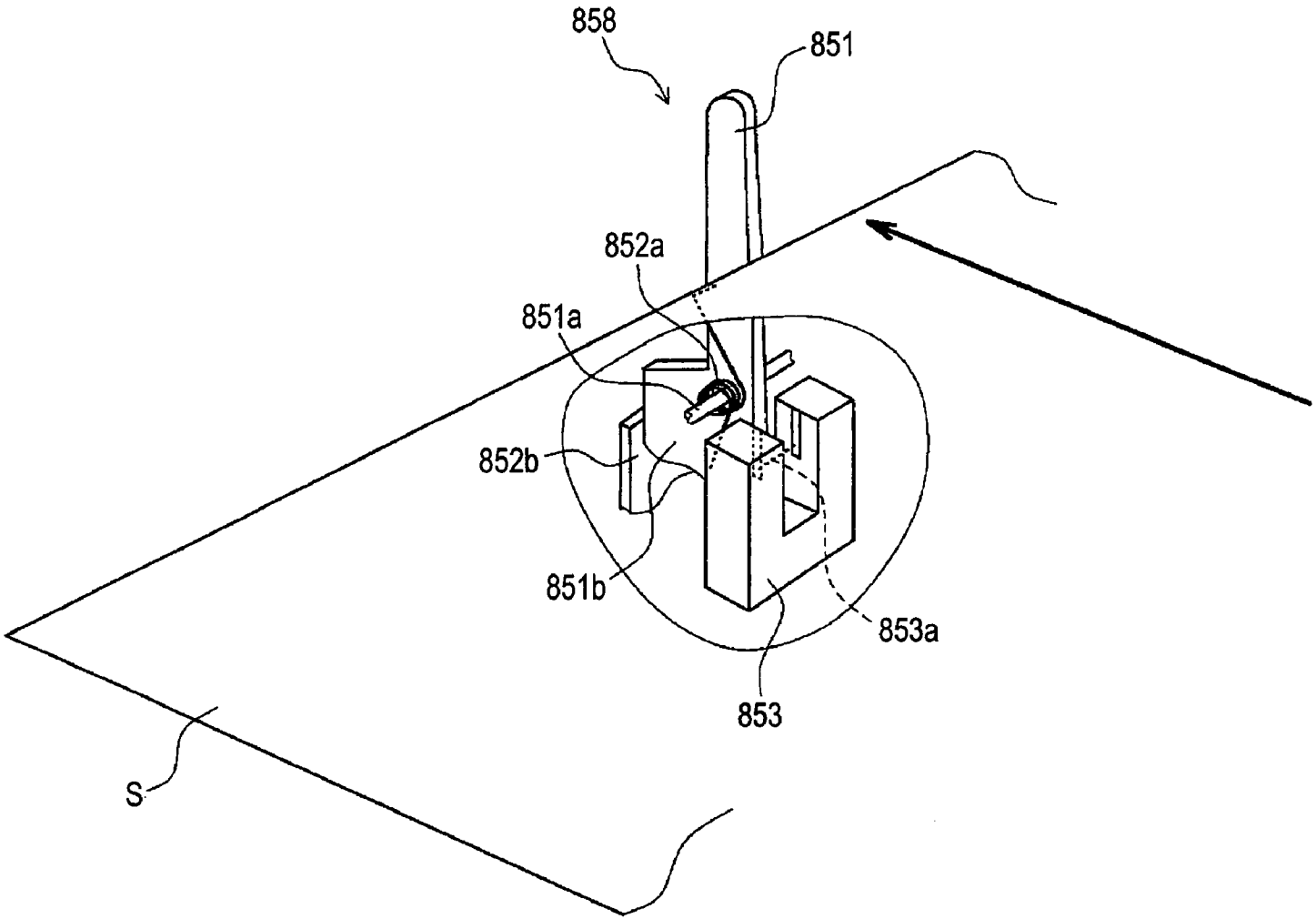
FIG. 14 PRIOR ART
FIG. 14 is a perspective view of a known sheet detection device.

(3) The sheet transport apparatus 42 according to the second embodiment determines whether the leading edge of the sheet S is curled and in which direction the curl is oriented by determining which pressure sensor among the pressure sensors 6*a* to 6*d* detects the contact with the leading edge of the sheet S. Accordingly, unlike the example of the known sheet transport apparatus shown in FIG. 15, the sheet transport apparatus 42 can detect the curl of the sheet S without using a plurality of flags. Therefore, the flag does not prevent the transportation of the sheet S even though the sheet S is thin. Furthermore, since the chance of the occurrence of chattering phenomenon decreases, the strength of the spring 7*b* of the sheet detection device 5 can be decreased. Therefore, the sheet transport apparatus 42 is suitable for transporting a thin sheet compared with the known sheet transport apparatus that includes a single flag shown in FIG. 14.

Figure 11:
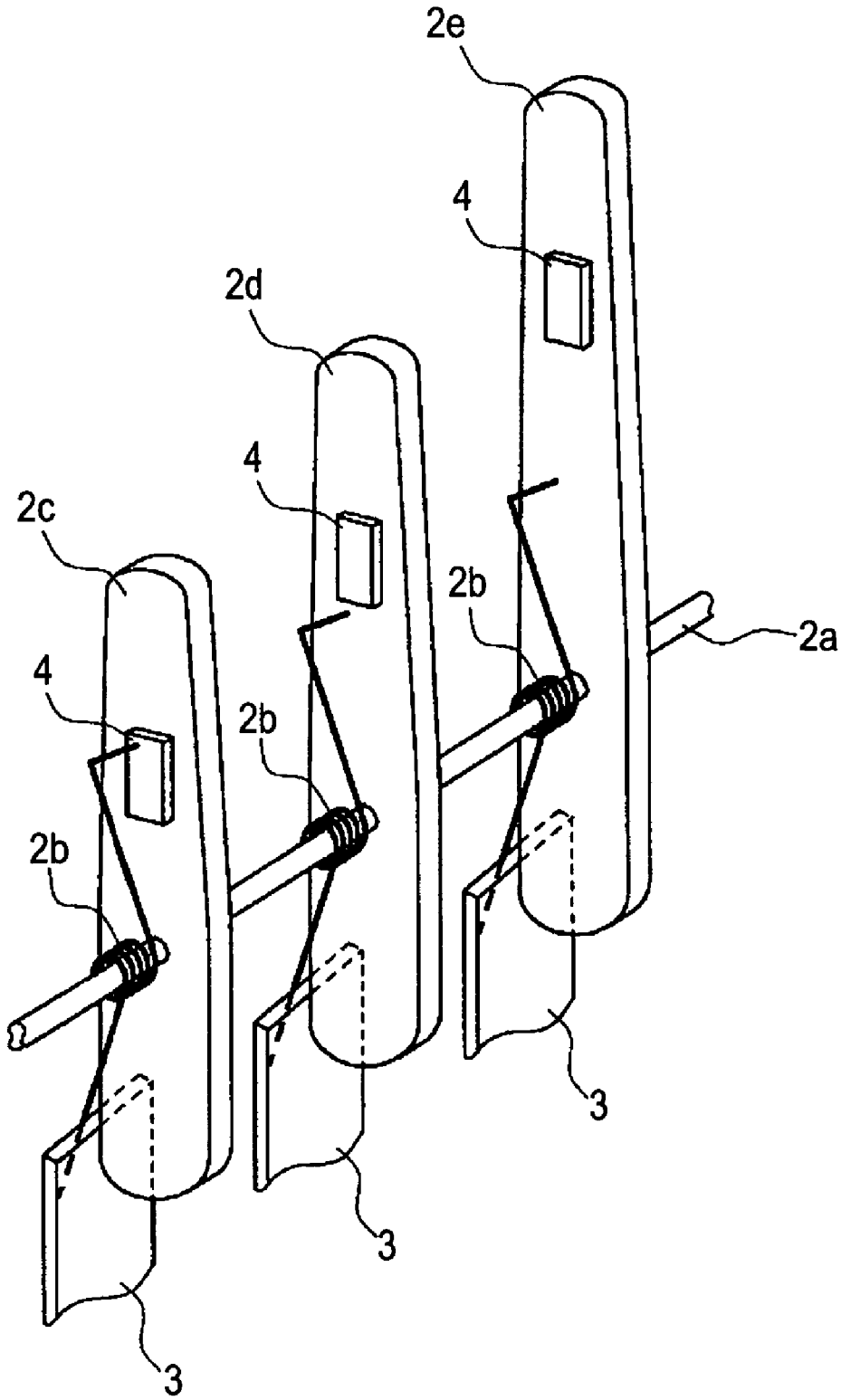
FIG. 11 is a perspective view of another example of the sheet detection device in the sheet transport apparatus according to the second embodiment.

In the above-described embodiments, a plurality of MEMS pressure sensors are mounted on the single flag 7. However, as shown in FIG. 11, the curled condition can also be determined by providing a plurality of flags having different lengths in the thickness direction of the sheet S. In an example shown in FIG. 11, the length of the flag of the sheet detection device 1 shown in FIG. 3 is changed to provide a plurality of flags 2*c*, 2*d*, and 2*e*, which are arranged as shown by the example of the known sheet transport apparatus shown in FIG. 15. These flags can detect the curled condition of the sheet S as in the example of the known sheet transport apparatus shown in FIG. 15. However, in the example shown in FIG. 11, the strength of the spring 2*b*, which returns the flag to the original position, can be decreased compared with that in the example shown in FIG. 15. As a result, the flags advantageously do not prevent the transportation of a thin sheet.

Additionally, in the example shown in FIG. 11, the MEMS acceleration sensor 4 is employed. However, using the above-described MEMS pressure sensor on each flag can provide the same advantages.

The flags 2, 2*c*, 2*d*, and 2*e* are tilted about the spindle 2*a*. However, as shown in FIG. 12A, a plate flag composed of an elastic material may be used.

Sheet Transport Apparatus According To Third Embodiment

Figure 12B:
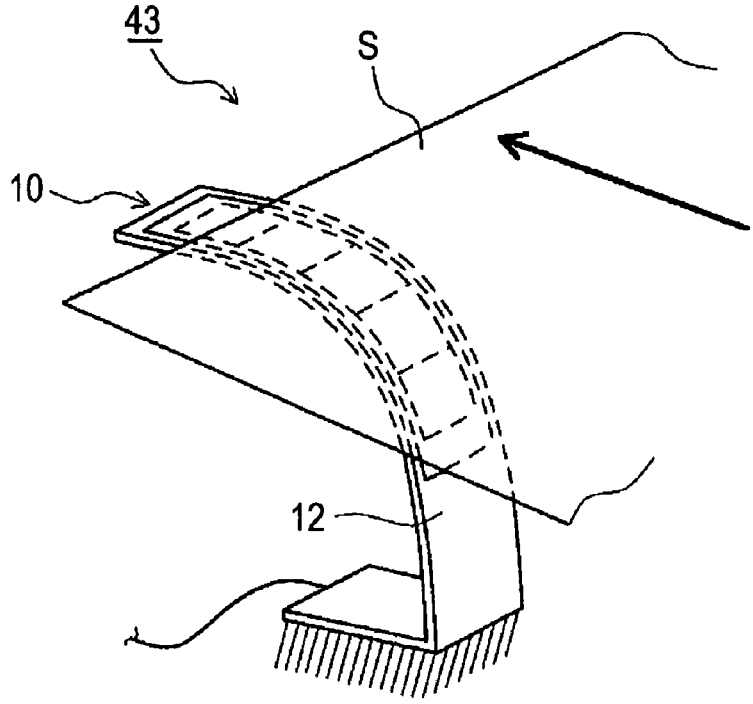

FIGS. 12A and 12B illustrate a sheet transport apparatus 43 according to a third embodiment of the present invention. The sheet transport apparatus 43 has a different sheet detection device from that shown in FIG. 8. FIGS. 12A and 12B only illustrate a different part in the different sheet detection device.

Pressure sensors 11*a* to 11*e* functioning as a sheet detection sensor in a sheet detection device 10 are mounted on a flag 12 functioning as a displacement member composed of an elastic plate material. The pressure sensors 11*a* to 11*e* are arranged in the thickness direction of a sheet S and are covered by a sheet cover 11. The pressure sensors 11*a* to 11*e* can transmit a signal to the controller 28 shown in FIG. 8.

When the sheet S is brought into contact with either one of the pressure sensors 11*a* to 11*e*, the sheet detection device 10 detects the leading edge of the sheet S. After the collision with the sheet S, the flag 12 elastically deflects towards the sheet feed direction so as to allow the sheet S to pass through, as shown in FIG. 12B. The MEMS sensor described in the second embodiment is suitably used for the pressure sensors 11*a* to 11*e*.

The sheet transport apparatus 43 including the sheet detection device 10 can determine the curled condition of the sheet S by determining which pressure sensor detects the collision with the leading edge of the sheet S. Accordingly, although the sheet transport apparatus 43 has the same function as the sheet transport apparatus 42, the sheet transport apparatus 43 provides the following specific features:

(1) As in the sheet transport apparatus 41 of the first embodiment, since the sheet transport apparatus 43 eliminates the photo interrupter 853 that the known detection sensors include, a large installation space is not required compared with the known sheet transport apparatus. This facilitates the installation of the sheet transport apparatus 43. In addition, the accuracy of the install position can be increased. Moreover, if the sheet detection device 10 has a wireless configuration, the installation is not restricted by wiring constraints of communication lines. Therefore, the ease of installation is further facilitated. Furthermore, since signal lines do not prevent the motion of the flag 12, the sheet S can pass through the flag 7 smoothly.

(2) The sheet transport apparatus 43 has a simpler structure by eliminating the spring 7*b* and the spindle 7*a*, compared with the flag 7 of the sheet transport apparatus 42 in the second embodiment. Accordingly, the risk of failure of the sheet detection device 10 decreases. In addition, the assembly of the sheet detection device 10 is facilitated.

(3) Since the flag 12 can be bonded to a mounting surface with an adhesive agent, the installation of the flag 12 is significantly facilitated.

(4) If a substrate on which the MEMS pressure sensor is formed is composed of an elastic material, the substrate and the flag 12 are integrated, thus providing a further simpler structure.

Sheet Transport Apparatus According To Fourth Embodiment

Figure 13A:
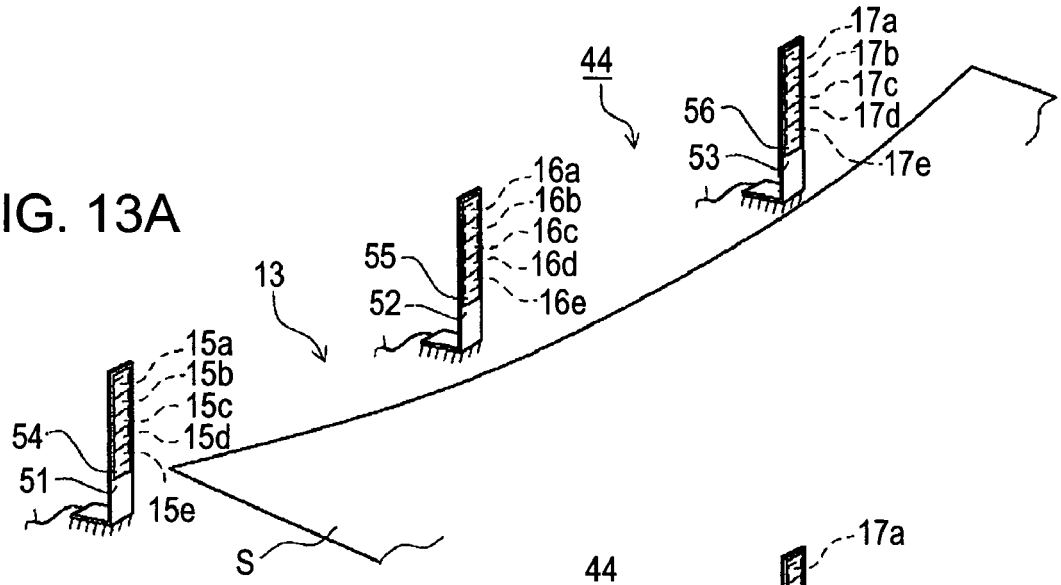
FIG. 13A is a perspective view of the sheet detection device when a whole transported sheet is curved in the direction perpendicular to the sheet transport direction (in the thickness direction of the sheet)
Figure 13B:
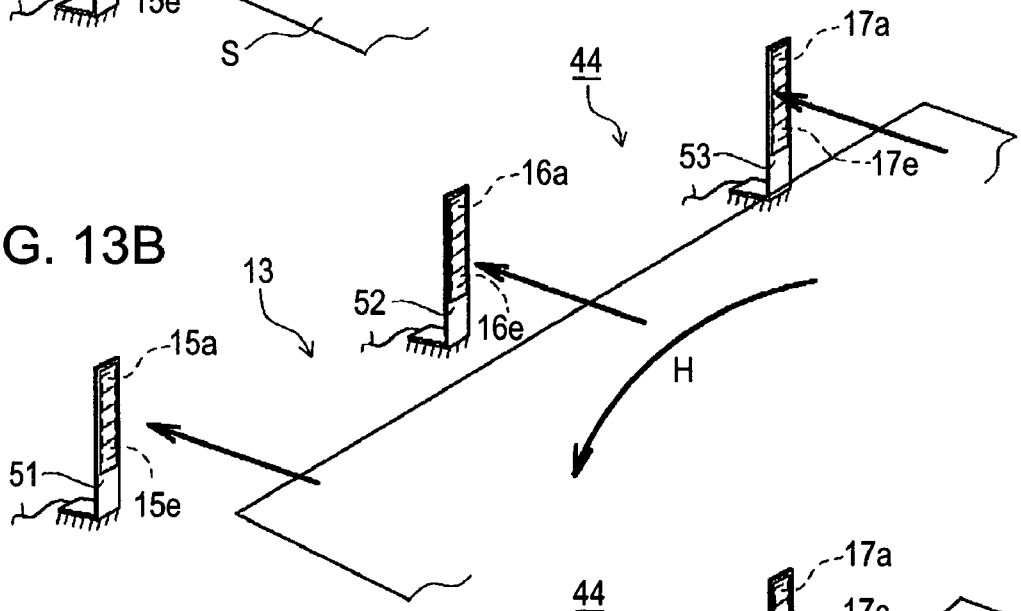
FIG. 13B is a perspective view of the sheet detection device when a whole transported sheet is skewed in the direction shown by arrow H.
Figure 13C:
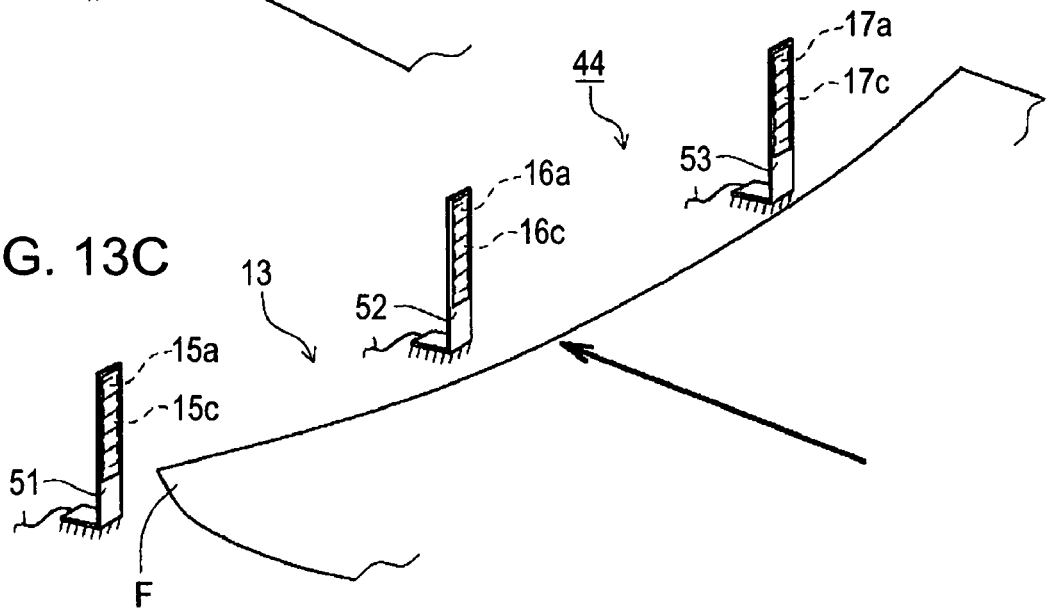
FIG. 13C is a perspective view of the sheet detection device when a side F of the leading edge of a sheet is curled upwards.

FIGS. 13A, 13B, and 13C illustrate a sheet transport apparatus 44 according to a fourth embodiment of the present invention. The sheet transport apparatus 44 has a different sheet detection device from that shown in FIG. 3. FIGS. 13A, 13B, and 13C only illustrate a different part in the different sheet detection device.

A set of pressure sensors 15*a* to 15*e*, a set of 16*a* to 16*e*, and a set of 17*a* to 17*e* functioning as a sheet detection sensor in a sheet detection device 13 are respectively mounted on flags 51, 52, and 53 functioning as displacement members composed of an elastic plate material. The pressure sensors in the sets are arranged in the thickness direction of a sheet S and are covered by sheet covers 54, 55, and 56, respectively. This structure is the same as the structure in which a plurality of the flags 12 shown in FIG. 12A is arranged in a sheet feeding area in the direction orthogonal to the sheet feed direction.

FIG. 13A illustrates the case where a whole sheet S transported is curved in a direction perpendicular to the sheet feed direction (i.e., in the thickness direction of the sheet S). FIG. 13B illustrates the case where the whole sheet S is skewed in a direction shown by arrow H. FIG. 13C illustrates the case where a side F of the leading edge of the sheet S is curled upwards.

By adopting the sheet detection device 13 including the pressure sensors, the sheet transport apparatus 44 according to the fourth embodiment can provide the following specific advantages as compared with known sheet transport apparatuses:

(1) As in the sheet transport apparatus 41 of the first embodiment, since the sheet transport apparatus 44 eliminates the photo interrupter 853 that the known detection sensors include, a large installation space is not required compared with the known sheet transport apparatus. This facilitates the installation of the sheet transport apparatus 42. In addition, the accuracy of the install position can be increased. Moreover, if the sheet detection device 13 has a wireless configuration, the installation is not restricted by wiring constraints of communication lines. Therefore, the installation is further facilitated. Furthermore, since the communication lines do not prevent the motion of the flags 51, 52, and 53, the sheet S can smoothly pass through the flags 51, 52, and 53.

Figure 15:
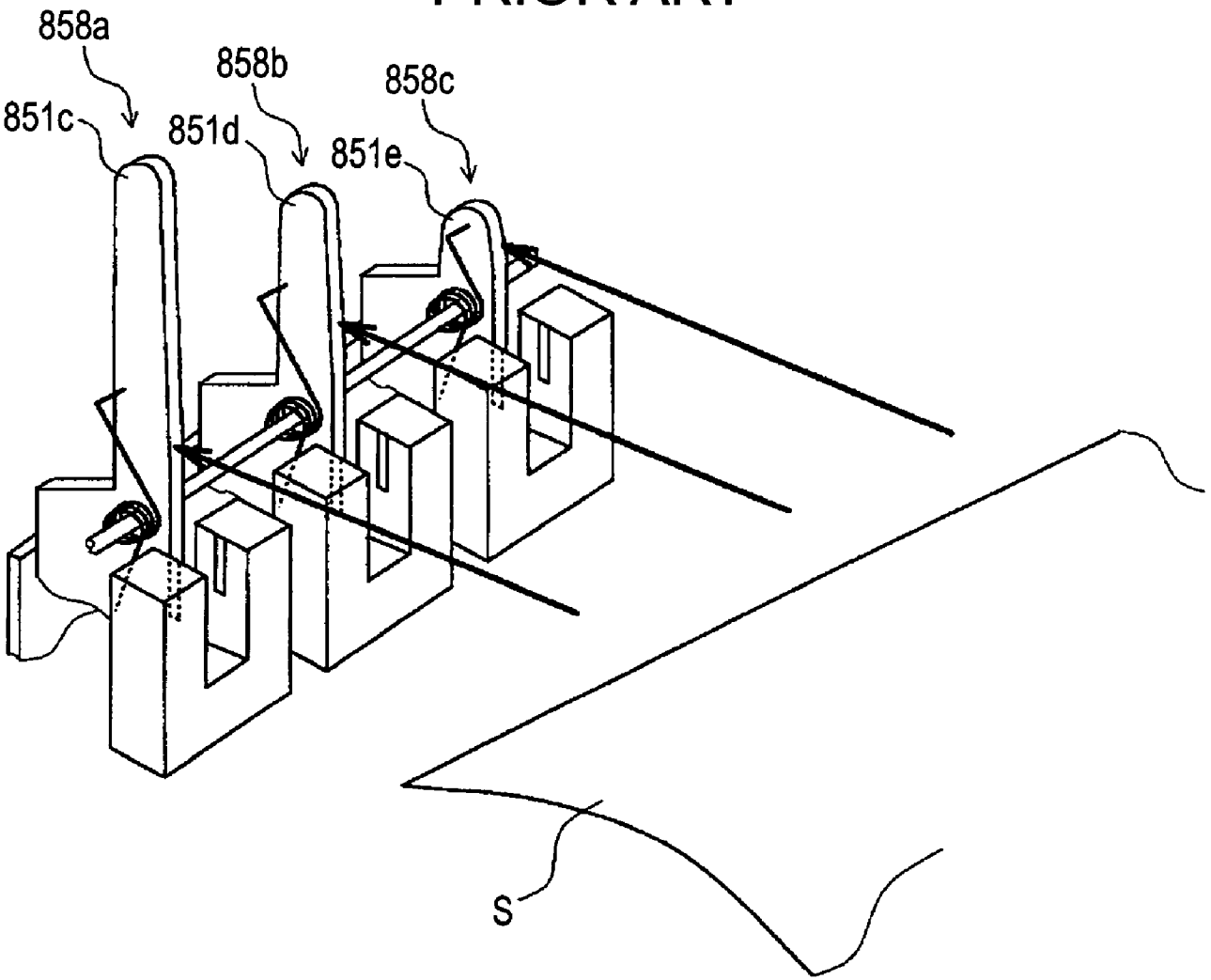
FIG. 15 PRIOR ART
FIG. 15 is a perspective view of a sheet detection unit using the sheet detection device shown in FIG. 14 to detect a curled sheet.

(2) The sheet detection device 13 can detect the curvature condition of the sheet S even when, as shown in FIG. 13A, the whole sheet S is curved in a direction perpendicular to the sheet feed direction (i.e., in the thickness direction of the sheet S). For example, if both sides of the leading edge of the sheet S are curved upwards, the sides of the leading edge of the sheet S collide with, for example, the upper pressure sensors 15*a* and 17*a* and the central portion of the leading edge of the sheet S collides with the lower pressure sensor 16*e*. Thus, the sheet transport apparatus 44 can determine the curvature of the sheet S from detection information sent from the pressure sensors. If the known sheet detection device attempts to obtain the same effect, a plurality of sensors shown in FIG. 15 are required. Since this structure prevents the transportation of a thin sheet, it is difficult to employ this structure in practice.

Figure 16:
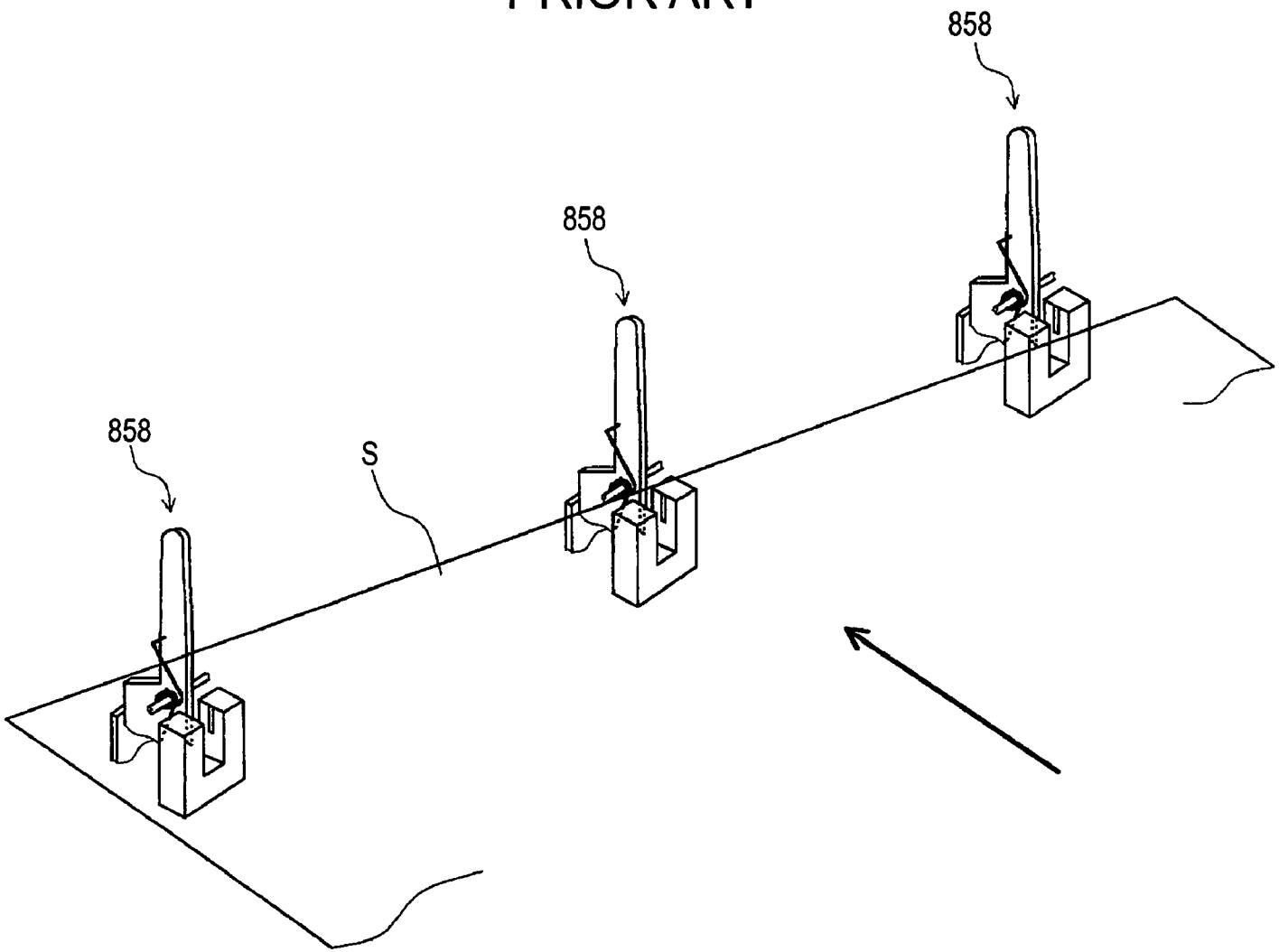
FIG. 16 PRIOR ART
FIG. 16 is a perspective view of a sheet detection unit using the sheet detection device shown in FIG. 14 to detect a skewed sheet.
Figure 17:
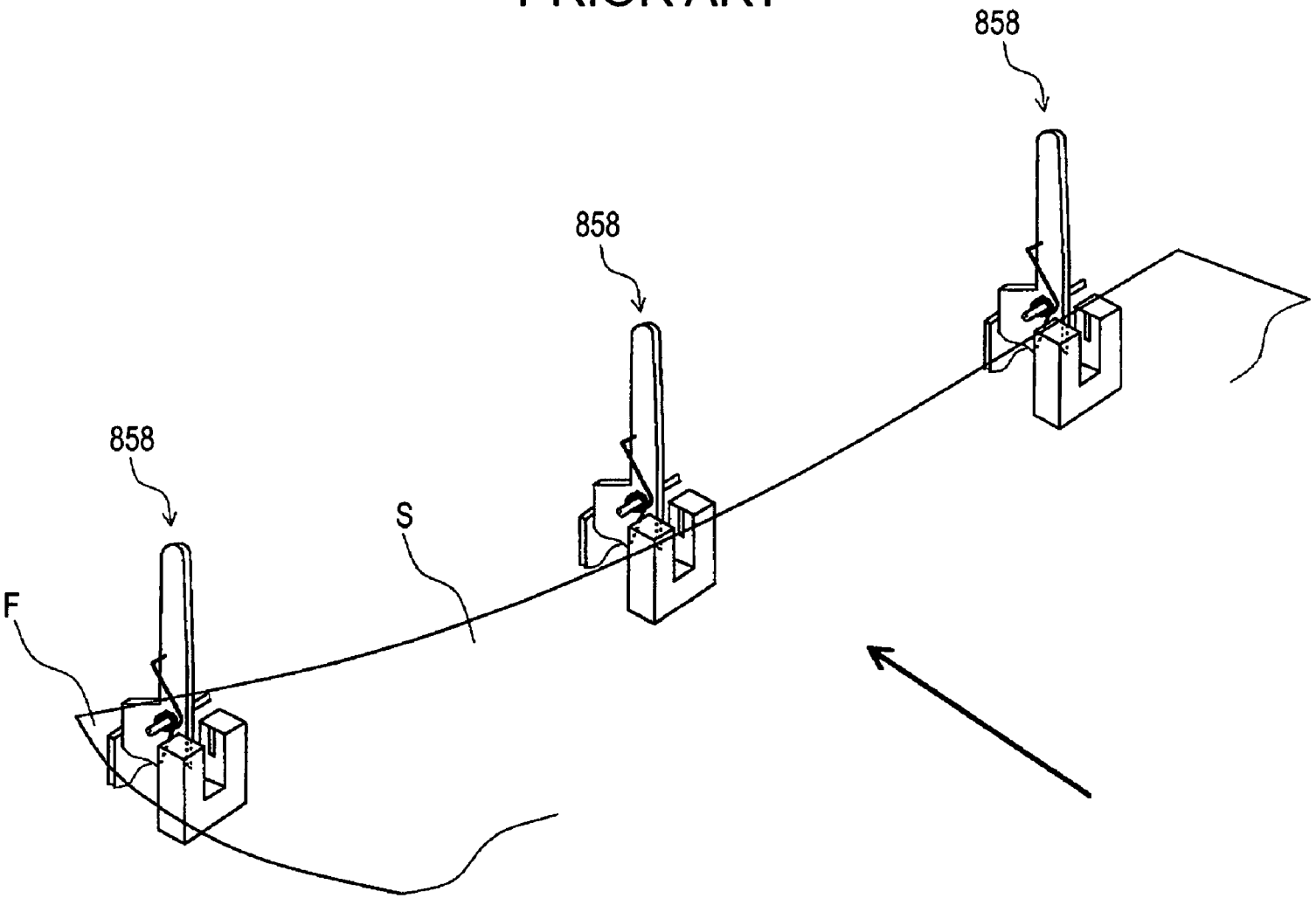
FIG. 17 PRIOR ART
FIG. 17 illustrates an erroneous sheet detection operation of the sheet detection unit shown in FIG. 16.

(3) The sheet transport apparatus 44 can distinguish the skew from the curl of the sheet S. For example, in both cases shown in FIGS. 13B and 13C, the timing of the leading edge of the sheet S reaching the pressure sensors are different sensor by sensor. This is because, as shown in FIG. 13C, if only the side F is curled upwards, the leading edge of the curled portion moves towards the downstream direction of the feed. Accordingly, in the cases shown in FIGS. 16 and 17, the known sheet transport apparatus cannot distinguish the skew from the curl of the sheet S. In contrast, in the case shown in FIG. 13C according to this embodiment, since the leading edge of the curled portion (side F) collides with, for example, the pressure sensor 15*a*, the sheet transport apparatus 44 can determine that the difference between the timings is caused by a curl, not a skew.

In the fourth embodiment, a flag composed of an elastic material is employed. However, a rotatably supported flag described in the second embodiment may be employed in place of the flag composed of an elastic material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-270331 filed Sep. 16, 2004, which is hereby incorporated by reference herein in its entirety.

What is claimed is:

1. A sheet transport apparatus comprising:

a sheet transport unit configured to transport a sheet; and a sheet detection unit configured to detect the sheet transported by the sheet transport unit, the sheet detection unit including a displacement member displaceable when urged by the sheet transported by the sheet transport unit and a single-chip sheet detection sensor attached to the displacement member and configured to detect the arrival of the sheet, wherein the displacement member is disposed so that the length direction of the displacement member is perpendicular to a transport surface of the sheet and the displacement member is tilted when urged by the sheet.

2. The sheet transport apparatus according to claim 1, further comprising a control unit controlling the sheet transport unit based on detection from the sheet detection sensor.

3. The sheet transport apparatus according to claim 2, further comprising a transmission unit configured to wirelessly transmit a sheet detection signal of the sheet detection sensor to the control unit.

4. The sheet transport apparatus according to claim 1, wherein the sheet detection unit includes a plurality of displacement members arranged along the width direction of the transported sheet.

5. The sheet transport apparatus according to claim 4, wherein the displacement members have different lengths in the length direction thereof.

6. The sheet transport apparatus according to claim 1, wherein the displacement member includes a tilting member that is elastically flexible.

7. The sheet transport apparatus according to claim 1, wherein a plurality of sheet detection sensors are attached to the displacement member along the length direction of the displacement member.

8. The sheet transport apparatus according to claim 4, wherein a plurality of sheet detection sensors are attached to the displacement member along the length direction of the displacement member.

9. The sheet transport apparatus according to claim 6, wherein a plurality of sheet detection sensors are attached to the displacement member along the length direction of the displacement member.

10. The sheet transport apparatus according to claim 1, wherein the sheet detection sensor includes an acceleration sensor configured to detect acceleration of the displacement member.

11. The sheet transport apparatus according to claim 4, wherein the sheet detection sensor includes an acceleration sensor configured to detect acceleration of the displacement member.

12. The sheet transport apparatus according to claim 6, wherein the sheet detection sensor includes an acceleration sensor configured to detect acceleration of the displacement member.

13. The sheet transport apparatus according to claim 1, wherein the sheet detection sensor includes a pressure sensor configured to receive the leading edge of the sheet so as to detect the arrival of the leading edge of the sheet.

14. The sheet transport apparatus according to claim 4, wherein the sheet detection sensor includes a pressure sensor configured to receive the leading edge of the sheet so as to detect the arrival of the leading edge of the sheet.

15. The sheet transport apparatus according to claim 6, wherein the sheet detection sensor includes a pressure sensor configured to receive the leading edge of the sheet so as to detect the arrival of the leading edge of the sheet.

16. The sheet transport apparatus according to claim 10, wherein the acceleration sensor comprises a detecting portion detecting the acceleration of the displacement member and an electrode externally transmitting an output signal from the detecting portion, and wherein the acceleration sensor is packaged as a chip device from a wafer on which the detecting portion and the electrode are formed by a semiconductor manufacturing process.

17. The sheet transport apparatus according to claim 11, wherein the acceleration sensor comprises a detecting portion detecting the acceleration of the displacement member and an electrode externally transmitting an output signal from the detecting portion, and wherein the acceleration sensor is packaged as a chip device from a wafer on which the detecting portion and the electrode are formed by a semiconductor manufacturing process.

18. The sheet transport apparatus according to claim 12, wherein the acceleration sensor comprises a detecting portion detecting the acceleration of the displacement member and an electrode externally transmitting an output signal from the detecting portion, and wherein the acceleration sensor is packaged as a chip device from a wafer on which the detecting portion and the electrode are formed by a semiconductor manufacturing process.

19. The sheet transport apparatus according to claim 13, wherein the pressure sensor comprises a detecting portion detecting the pressure of the leading edge of the sheet urging against the detecting portion and an electrode externally transmitting an output signal from the detecting portion, and wherein the pressure sensor is packaged as a chip device from a wafer on which the detecting portion and the electrode are formed by a semiconductor manufacturing process.

20. The sheet transport apparatus according to claim 14, wherein the pressure sensor comprises a detecting portion detecting the pressure of the leading edge of the sheet urging against the detecting portion and an electrode externally transmitting an output signal from the detecting portion, and wherein the pressure sensor is packaged as a chip device from a wafer on which the detecting portion and the electrode are formed by a semiconductor manufacturing process.

21. The sheet transport apparatus according to claim 15, wherein the pressure sensor comprises a detecting portion detecting the pressure of the leading edge of the sheet urging against the detecting portion and an electrode externally transmitting an output signal from the detecting portion, and wherein the pressure sensor is packaged as a chip device from a wafer on which the detecting portion and the electrode are formed by a semiconductor manufacturing process.

22. An image forming apparatus comprising:

a sheet transport unit configured to transport a sheet;

a sheet detection unit detecting the sheet transported by the sheet transport unit; and an image forming unit configured to form an image on the sheet transported by the sheet transport unit, wherein the sheet detection unit includes a displacement member displaceable when urged by the sheet transported by the sheet transport unit and a single-chip sheet detection sensor attached to the displacement member and configured to detect arrival of the sheet, and the displacement member is disposed so that the length direction of the displacement member is perpendicular to a transport surface of the sheet and the displacement member is tilted when urged by the sheet.

23. The image forming apparatus according to claim 22, wherein the sheet detection sensor includes an acceleration sensor configured to detect acceleration of the displacement member.

24. The image forming apparatus according to claim 23, wherein the acceleration sensor comprises a detecting portion detecting the acceleration of the displacement member and an electrode externally transmitting an output signal from the detecting portion, and wherein the acceleration sensor is packaged as a chip device from a wafer on which the detecting portion and the electrode are formed by a semiconductor manufacturing process.

* * * * *